US011992166B2

(12) United States Patent
Li et al.

(10) Patent No.: US 11,992,166 B2
(45) Date of Patent: May 28, 2024

(54) CLEANING ASSEMBLY AND CLEANING APPARATUS

(71) Applicants: YUNJING INTELLIGENCE INNOVATION (SHENZHEN) CO., LTD., Shenzhen (CN); YUNJING INTELLIGENCE (SHENZHEN) CO., LTD., Shenzhen (CN)

(72) Inventors: Xingyan Li, Shenzhen (CN); Yu Ai, Shenzhen (CN); Junbin Zhang, Shenzhen (CN); Weijing Lin, Shenzhen (CN)

(73) Assignees: YUNJING INTELLIGENCE INNOVATION (SHENZHEN) CO., LTD., Shenzhen (CN); YUNJING INTELLIGENCE (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/588,135

(22) Filed: Jan. 28, 2022

(65) Prior Publication Data

US 2022/0248932 A1 Aug. 11, 2022

(30) Foreign Application Priority Data

Feb. 10, 2021 (CN) ..... 202120374489.4
Nov. 15, 2021 (CN) ..... 202122798800.0

(51) Int. Cl.
*A47L 11/40* (2006.01)
*A47L 11/24* (2006.01)

(52) U.S. Cl.
CPC ..... *A47L 11/4069* (2013.01); *A47L 11/24* (2013.01); *A47L 11/4038* (2013.01);
(Continued)

(58) Field of Classification Search
CPC ..... A47L 11/24; A47L 11/28; A47L 11/282; A47L 11/4038; A47L 11/4055; A47L 11/4058
See application file for complete search history.

(56) References Cited

U.S. PATENT DOCUMENTS 5,815,880 A 10/1998 Nakanishi
5,991,951 A * 11/1999 Kubo ..... A47L 11/16 15/49.1

(Continued)

FOREIGN PATENT DOCUMENTS

CN 209032139 U * 6/2019
CN 209032139 U 6/2019

(Continued)

*Primary Examiner* — Randall E Chin

(57) ABSTRACT

The present disclosure provides a cleaning assembly including a cleaning performing device. The cleaning performing device includes a cleaning module configured to clean a surface and a cleaning driving module configured to drive the cleaning module to move relative to the surface, a driving device configured to drive the cleaning performing device to be lifted or lowered, and a constraining structure configured to constrain a lifting or lowering trajectory of the cleaning performing device. The present disclosure further provides a cleaning apparatus. The cleaning performing device can be lifted or lowered according to an actual need, such that improves an adaptability of the cleaning apparatus. Further, the lifting or lowering trajectory of the cleaning performing device can be constrained by the constraining structure, such that improves a stability of the cleaning apparatus during moving up and down.

17 Claims, 14 Drawing Sheets

(52) U.S. Cl.
CPC ..... *A47L 11/4055* (2013.01); *A47L 11/4058* (2013.01); *A47L 2201/00* (2013.01)

(56) References Cited

U.S. PATENT DOCUMENTS

| | | | | |
|---|---|---|---|---|
| 11,523,726 | B2 * | 12/2022 | Fang | A47L 11/4055 |
| 2003/0000549 | A1 | 1/2003 | Joynt et al. | |
| 2017/0360270 | A1 * | 12/2017 | Dickrell | A47L 11/10 |
| 2019/0261826 | A1 | 8/2019 | Goff | |
| 2020/0297179 | A1 * | 9/2020 | Fang | A47L 11/4069 |

FOREIGN PATENT DOCUMENTS

| | | | | |
|---|---|---|---|---|
| CN | 209808233 | U | | 12/2019 |
| CN | 210643918 | U | * | 6/2020 |
| CN | 111743469 | A | * | 10/2020 |
| CN | 213963240 | U | * | 8/2021 |
| EP | 3711649 | A1 | | 9/2020 |

* cited by examiner

CLEANING ASSEMBLY AND CLEANING APPARATUS

CLAM OF PRIORITY

This application claims priority to Chinese Application No. 202120374489.4, filed on Feb. 10, 2021, and Chinese Application No. 202122798800.0, filed on Nov. 15, 2021, which are hereby incorporated by reference in its entirety.

TECHNICAL FIELD

The present disclosure relates to technical field of cleaning apparatus, and in particular to a cleaning assembly and a cleaning apparatus.

BACKGROUND

With the development of science and technology, cleaning apparatus, such as cleaning robots, are used by more and more peoples. The cleaning apparatus includes a cleaning performing device, such as a mopping performing device. The cleaning performing device includes a cleaning module and a cleaning driving module, the cleaning driving module is configured to drive the cleaning module to rotate relative to ground or other surfaces to be cleaned to improve the cleaning effect. However, the cleaning performing device in the prior art cannot be lifted or lowered relative to a body of the cleaning apparatus, so the cleaning apparatus is short of adaptability.

SUMMARY

A first objective of the present disclosure is to provide a cleaning assembly whose cleaning performing device can be lifted up and down relative to a body of the cleaning apparatus, so as to improve an adaptability of the cleaning apparatus.

A second objective of the present disclosure is to provide a cleaning apparatus whose cleaning performing device can be lifted up and down relative to a body of the cleaning apparatus, so as to improve an adaptability of the cleaning apparatus.

The present disclosure provides a cleaning assembly which is configured to be fixed on a body of a cleaning apparatus through a fixing structure. The cleaning assembly includes:

a cleaning performing device including a cleaning module configured to clean a surface to be cleaned, and a cleaning driving module configured to drive the cleaning module to move relative to the surface to be cleaned;

a driving device configured to drive the cleaning performing device to be lifted or lowered; and a constraining structure configured to limit a lifting or lowering trajectory of the cleaning performing device.

In some instances, the constraining structure includes a linkage structure connected between the cleaning performing device and the fixing structure, and the linkage structure is linked to move to limit the lifting or lowering trajectory of the cleaning performing device.

In some instances, the linkage structure is configured to move with a first fixed trajectory to limit lifting or lowering of the cleaning performing device with a second fixed trajectory; and/or constraints of the linkage structure to the cleaning performing device allows the cleaning performing device to swing during lifting or lowering.

In some instances, the linkage structure is movably connected with the cleaning performing device and the fixing structure, the linkage structure, the cleaning performing device, and the fixing structure cooperatively form a multi-linkages structure.

In some instances, the linkage structure includes a first connecting rod and a second connecting rod opposite to the first connecting rod, a first end of the first connecting rod is hinged to the cleaning performing device and a second end of the first connecting rod is hinged to the fixing structure, a first end of the second connecting rod is hinged to the cleaning performing device and a second end of the second connecting rod is hinged to the fixing structure, and multi-linkages structure is a parallelogram linkage structure.

In some instances, the constraining structure includes a swinging arm having a first end connected to the cleaning performing device, and a second end rotatably connected to the fixing structure. The swinging arm is configured to swing to constrain a trajectory of the cleaning performing device of swing up and down.

In some instances, the constraining structure includes a first structure arranged on the cleaning performing device and a second structure connected to the fixing structure, the first structure is configured to be lifted or lowered relative to the second structure, and the second structure is configured to constrain a lifting or lowering trajectory of the first structure.

In some instances, the first structure is slidably matched with or engaged with the second structure to guide lifting or lowering of the cleaning performing device; and/or the cleaning assembly further includes a swing structure connected to an output end of the driving device and the cleaning performing device, and the swing structure is driven by the driving device to drive the cleaning performing device to swing up and down.

In some instances, the constraining structure includes a plurality of tension ropes, one end of each of the plurality of tension ropes is connected to the cleaning performing device to tension the cleaning performing device, and tensions of the plurality of tension ropes are configured to constrain the lifting or lowering trajectory of the cleaning performing device.

In some instances, the driving device includes a power source and a transmitting mechanism connected between the power source and the cleaning performing device to transmit motion, the transmitting mechanism includes a gear; and the cleaning performing device includes a rack engaged with the gear, the rack is driven by the gear to be lifted when the gear rotates in a first direction, and the rack is driven by the gear to be lowered when the gear rotates in a second direction opposite to the first direction.

In some instances, the constraining structure includes a linkage structure connected between the cleaning performing device and the fixing structure, the linkage structure has a fixed trajectory matched to a trajectory of the rack; and the linkage structure is linked to move to constrain the lifting or lowering trajectory of the cleaning performing device.

In some instances, the driving device includes a power source, and a transmitting mechanism connected between the power source and the cleaning performing device to transmit motion, the transmitting mechanism includes a moving member capable of moving up and down, the cleaning performing device is configured to be lifted by the moving member along with lifting of the moving member, and the cleaning performing device is also configured to fall back along with lowering of the moving member.

In some instances, the driving device includes a power source, and a transmitting mechanism connected between the power source and the cleaning performing device to transmit motion, the transmitting mechanism includes a driving wheel driven by the power source, at least one driven wheel, and a transmitting belt arranged around the driving wheel and the at least one driven wheel and connected to the cleaning performing device, the transmitting belt is configured to drive the cleaning performing device to be lifted when the driving wheel rotates in a first direction, and the transmitting belt is configured to drive the cleaning performing device to be lowered when the driving wheel rotates in a second direction opposite to the first direction.

In some instances, the transmitting mechanism includes at least two driven wheels, and a movable tensioning structure, one of the at least two driven wheels is mounted on the tensioning structure, the transmitting belt is configured to remain in a tensioned state under an action of the tensioning structure and the driven wheel, and positions of the transmitting belt, the driven wheel mounted on the tensioning structure, and the tensioning structure are adaptively changed according to a change of a movement trajectory of the cleaning performing device under constraints of the constraining structure.

In some instances, the driving device includes a power source, and a transmitting mechanism connected between the power source and the cleaning performing device to transmit motion, the transmitting mechanism includes a winding mechanism, the winding mechanism includes a winding wheel driven by the power source and a winding belt connected to the winding wheel, one end of the winding belt away from the winding wheel is connected to the cleaning driving module, the winding belt is wound on the winding wheel to drive the cleaning driving module to be lifted under constraints of the constraining structure when the winding wheel rotates in a first direction, the winding belt is gradually loosen from the winding wheel when the winding wheel rotates in a second direction opposite to the first direction, and the cleaning performing device is configured to fall back under the constraints of the constraining structure.

In some instances, the driving device includes a power source, and a transmitting mechanism connected between the power source and the cleaning performing device to transmit motion. The transmitting mechanism includes a moving member driven by the power source to perform a reciprocating linear movement, and the moving member includes a first sliding part. The cleaning performing device includes a second sliding part slidably matched with the first sliding part, the first sliding part is configured to be lifted relative to the second sliding part along a direction angled with a first direction under constraints of the constraining structure when the moving member moves in the first direction.

In some instances, the driving device includes a power source fixed to the cleaning performing device, and a transmitting mechanism connected to the power source to transmit motion. The transmitting mechanism includes a gear engaged with a rack connected to the fixing structure, the driving device and the cleaning performing device are driven to be lifted when the gear rotates in a first direction and moves upward along the rack, and the driving device and the cleaning performing device are driven to be lowered when the gear rotates in a second direction opposite to the first direction and moves downward.

In some instances, the driving device includes a power source fixed to the cleaning performing device, and a transmitting mechanism connected to the power source to transmit motion. The transmitting mechanism includes a screw rod, a gear connected with the power source and the screw rod to drive the screw rod to rotate, and a sliding block threaded to the screw rod and connected to the constraining structure. The screw rod is configured to rotate to drive the sliding block and the constraining structure to be lifted or lowered.

In some instances, the constraining structure includes two opposite side plates, an inner wall of each of the two side plates is provided with at least one guiding wheel. The driving device includes a mounting bracket having a guiding surface on each of two opposite sides thereof, and the guiding wheels are configured to rotate on the guiding surfaces to guide the constraining structure to be lifted or lowered.

The present disclosure further provides a cleaning apparatus includes the aforementioned cleaning assembly.

In the present disclosure, the cleaning performing device of the cleaning apparatus can be driven by the driving device to be lifted or lowered based on an actual need, such that improves an adaptability of the cleaning apparatus. Further, during moving up and down, the position of the cleaning performing device can be constrained by the constraining structure, such that improves a stability of the cleaning apparatus during lifting or lowering.

DETAILED DESCRIPTION

In order to explain in detail the technical content, construction features, the purpose and effect achieved by the present disclosure, the following combined with the implementation and the attached drawings are described in detail.

The present disclosure provides a cleaning performing device, which includes a body and a cleaning assembly arranged on the body. The cleaning assembly is used to clean the ground. The cleaning apparatus can be, but is not limited to, a cleaning robot. The cleaning assembly can be, but is not limited to, a mopping assembly (as shown in the attached figures).

Figure 1:
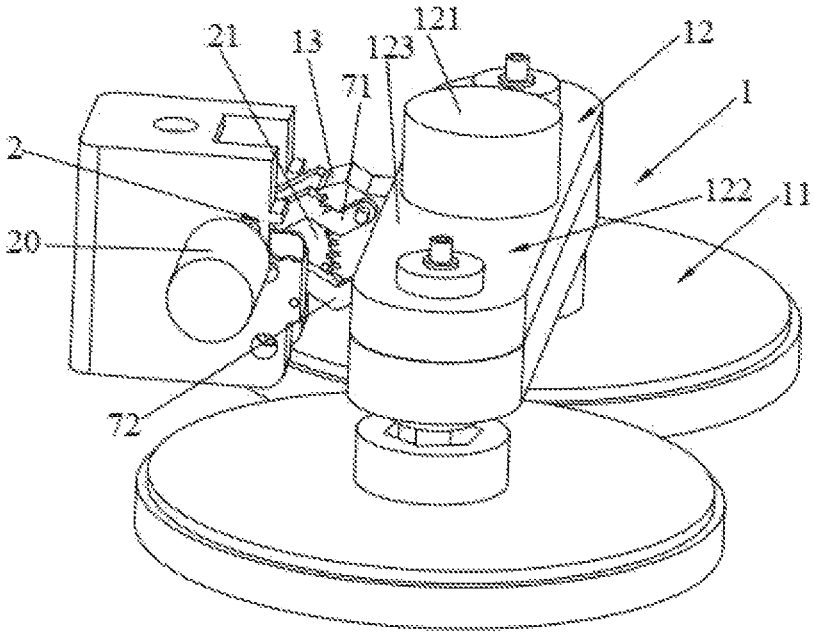
FIG. 1 is a structural diagram of a cleaning assembly according to an embodiment of this disclosure.
Figure 2:
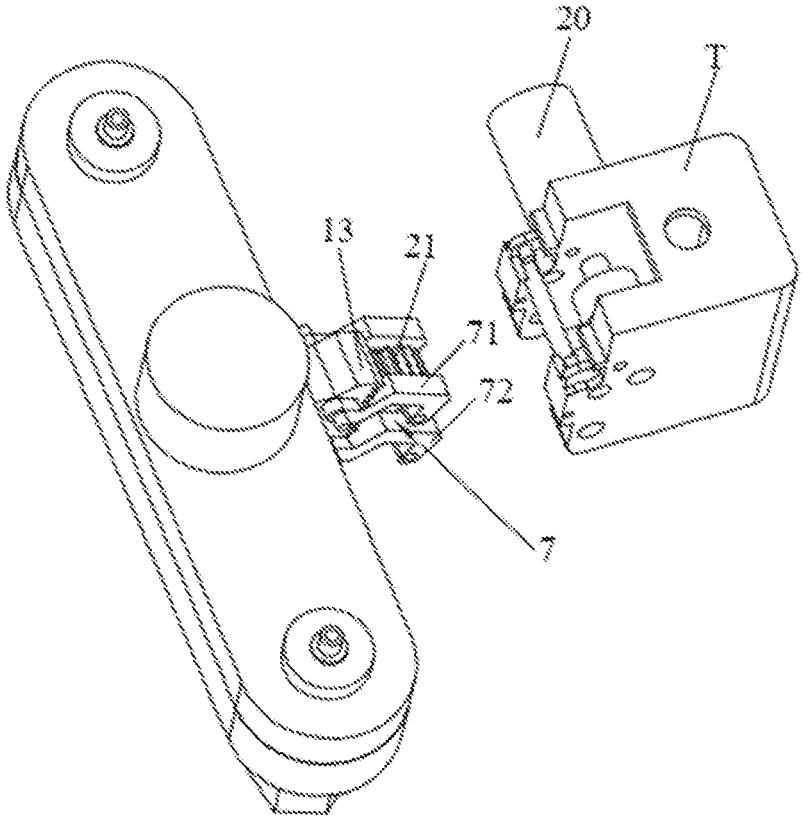
FIG. 2 is an exploded diagram of some parts of the cleaning assembly in FIG. 1.

Please referring to FIG. 1 and FIG. 2, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to move up and down. The constraining structure is configured to constrain a lifting or lowering trajectory of the cleaning performing device 1. The cleaning assembly is configured to be fixed on a body of a cleaning apparatus through a fixing structure.

In some embodiments, the cleaning performing device 1 may move up and down under an action of the driving device 2 according to an actual need, such that improves an adaptability of the cleaning apparatus. Moreover, the position of the cleaning performing device 1 during moving up and down may be constrained by the constraining structure, such that improves a stability of the cleaning performing device 1 during moving up and down.

In some embodiments, the cleaning driving module 12 includes a cleaning power source 121, and a cleaning transmitting mechanism 122, and the cleaning transmitting mechanism 122 is configured to connect between the cleaning power source 121 and the cleaning module 11 to transmit motion, and bring the cleaning module 11 to move under a driving of the cleaning power source 121. In some embodiments, the cleaning transmitting mechanism 122 is arranged in a transmitting box 123.

In some embodiments, the cleaning driving module 12 is not limited to the above form, the cleaning driving module 12 may have other form as long as it can drive the cleaning module 11 to move.

In some embodiments, the cleaning module 11 is driven by the cleaning driving module 12 to rotate relative to the ground around a vertical axis to clean the ground. Of course, the cleaning module 11 is not limited to a specific form, and a movement mode of the cleaning module 11 is also not limited to a form as shown in FIGS. 1 and 2. For example, the cleaning module 11 may also rotate relative to the ground around a horizontal axis or vibrate relative to the ground under a driving of the cleaning driving module 12.

In some embodiments, the driving device 2 includes a power source 20 and a transmitting mechanism, and the transmitting mechanism is connected between the power source 20 and the cleaning performing device 1 to transmit motion.

The transmitting mechanism includes a gear 21, and the cleaning performing device 1 includes a rack 13 engaged with the gear 21. When the gear 21 rotates in a first direction, the rack 13 is driven by the gear 21 to move upward. When the gear 21 rotates in a second direction opposite to the first direction, the rack 13 is driven by the gear 21 to move downward. With a cooperation of the rack 13 and the gear 21, the cleaning performing device 1 may move up and down stably.

The power source 20 can be, but is not limited to, a motor. The power source 20 is installed on a fixing base T. The fixing base T may be integrally formed in the body of the cleaning apparatus, or may be fixedly connected to the body directly or indirectly.

In some embodiments, the gear 21 may be directly connected to an output end of the power source 20, or may be indirectly connected to an output end of the power source 20. In an example as shown in FIG. 1, the gear 21 is connected to the output end of the power source 20 through a driving gear 22.

In some embodiments, the rack 13 may be integrally formed on a component of the cleaning performing device 1 (ie, the rack 13 and the component is regarded as one part), or may be fixedly connected to a component of the cleaning performing device 1. For example, when the cleaning performing device 1 includes the transmitting box 123, the rack 13 may be integrally formed with the transmitting box 123 or fixedly connected to the transmitting box 123.

In some embodiments, the constraining structure includes a linkage structure 7. The linkage structure 7 is connected between the cleaning performing device 1 and a fixing structure, and has a fixed trajectory. The linkage structure 7 is linked to move to constrain the position of the cleaning performing device 1 during moving up and down. A trajectory of the rack 13 is matched with the fixed trajectory of the linkage structure 7. Since the trajectory of the linkage structure 7 as the constraining structure is matched with the trajectory of the rack 13 moving along the gear 21, the rack 13 may be constrained to always engage with the gear 21 during a movement of the rack 13, thereby ensuring that the cleaning performing device 1 can move up and down stably. The fixing structure may be, but is not limited to, the fixing base on which the power source 20 is arranged, the fixing structure may also be a relatively fixed structure. In the present disclosure, the linkage structure 7 may move relative to the cleaning performing device 1 during the cleaning performing device moving up and down.

It should be noted that the position where the linkage structure 7 is connected to the cleaning performing device 1 is not limited. In a specific example, the linkage structure 7 is connected to a side wall of the rack 13.

Further, the rack 13 is an arc-shaped rack. The linkage structure 7 with a fixed trajectory is configured to constrain the cleaning performing device 1 to swing up and down, so that the cleaning performing device 1 may change between an upward state and a downward state to generate a position deviation (along an up and down direction).

Further, the linkage structure 7 is movably connected to the cleaning performing device 1 and the fixing structure, and the linkage structure 7, the cleaning performing device 1 and the fixing structure cooperatively form a multi-linkages structure. Specifically, the linkage structure 7 includes a first connecting rod 71 located on an upper side of the linkage structure 7 and a second connecting rod 72 located on a lower side of the linkage structure 7. Both ends of the first connecting rod 71 are hinged to the cleaning performing device 1 and the fixing structure respectively. Both ends of the second connecting rod 72 are hinged to the cleaning performing device 1 and the fixing structure respectively, and the multi-linkages structure is a parallelogram linkage structure. Through this technical mean, the cleaning performing device 1 may be constrained to swing up and down reliably.

In some embodiments, a connecting position of the cleaning performing device 1 and the first connecting rod 71 is vertically opposite to a connecting position of the cleaning performing device 1 and the second connecting rod 72. A connecting position of the fixing structure and the first connecting rod 71 is exactly opposite to a connecting position of the fixing structure and the second connecting rod 72 in a vertical direction. Through this technical mean, the cleaning performing device 1 can maintain a same posture during moving up and down to avoid a skew.

The linkage structure 7 is not limited to the above-mentioned form, the linkage structure 7 can be other structure as long as it can constrain the cleaning performing device 1 to move up and down stably. Further, in order to ensure the reliability of the cooperation between the gear 21 and the rack 13, the linkage structure 7 may include two groups of linkage structure respectively arranged on opposite sides of the gear 21 and the rack 13, but the linkage structure 7 may also have other kinds of structures. In some embodiments, the cleaning assembly further includes an elastic structure (not shown) acting on the linkage structure 7. When the cleaning performing device 1 moves upward, the elastic structure is configured to store an elastic potential energy, and when the cleaning performing device moves downward, the elastic structure is configured to release the elastic potential energy. In this way, when cleaning the ground, etc., the cleaning apparatus may float on the uneven ground, and have a shock absorption effect at the same time.

In some embodiments, the constraining structure may include a swinging arm, a first end of the swinging arm is connected with the cleaning performing device 1, and a second end of the swinging arm is rotatably connected to the fixing structure. During the cleaning performing device 1 moving up and down, the swinging arm is configured to constrain a trajectory of the cleaning performing device 1 of swing up and down.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect.

Figure 3:
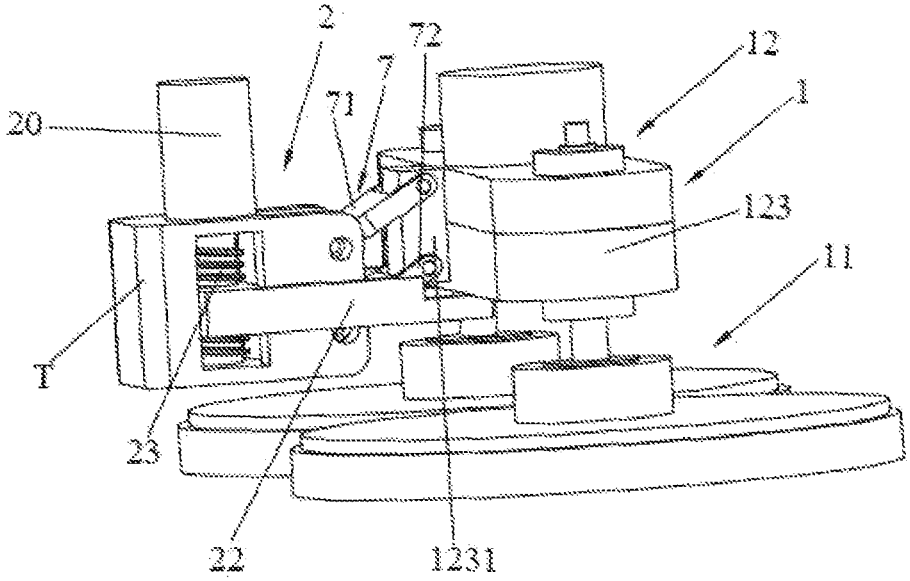
FIG. 3 is a structural diagram of a cleaning assembly according to an embodiment of this disclosure.

Please referring to FIG. 3, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

The cleaning performing device 1 as shown in FIG. 3 is basically the same as the cleaning performing device 1 as shown in FIGS. 1 and 2, which will not be repeated here.

In some embodiments, the driving device 2 includes a power source 20 and a transmitting mechanism, and the transmitting mechanism is connected between the power source 20 and the cleaning performing device 1 to transmit motion. The transmitting mechanism includes a moving member 22 capable of moving up and down. When moving upward, the moving member 22 is configured to lift the cleaning performing device 1 upward. When the moving member 22 moves downward, the cleaning performing device 1 loses its support and falls backward. Specifically, the power source 20 may be, but is not limited to, a motor.

In some embodiments, the power source 20 can be installed on a fixing base T, and the fixing base T may be integrally formed in the body of the cleaning apparatus, or may be fixedly connected to the body directly or indirectly. An output end of the power source 20 is connected with a screw rod 23, and the moving member 22 is threadedly matched with the screw rod 23. When the screw rod 23 rotates under a driving of the power source 20, the moving member 22 may move up and down to lift up the cleaning performing device 1, or the cleaning performing device 1 loses its support. The moving member 22 may have a single-piece structure or may be a combination of at least two structures. For example, the moving member 22 may include a main structure and a screw nut fixedly connected to the main structure, and the moving member 22 is matched to the screw rod 23 through the screw nut.

In some embodiments, the constraining structure includes a linkage structure 7 connected between the cleaning performing device 1 and a fixing structure. During the cleaning performing device 1 moving up and down, the linkage structure 7 is linked to move to constrain the position of the cleaning performing device 1. With the arrangement of the linkage structure 7, the position of the cleaning performing device 1 during moving up and down can be constrained, so as to ensure the stability of the up and down movement of the cleaning performing device 1. The fixing structure may be, but is not limited to, the fixing base T. Of course, the linkage structure 7 may be arranged at different positions, and the number of the linkage structure 7 is also not limited.

In some embodiments, the linkage structure 7 is configured to move in a fixed trajectory to constrain a movement up and down of the cleaning performing device 1 with a fixed trajectory. Of course, the linkage structure 7 is not constrained to move with the fixed trajectory.

In some embodiments, constraints of the linkage structure 7 to the cleaning performing device 1 allows the cleaning performing device 1 to swing during moving up and down, thereby causing the cleaning performing device 1 to generate a positional deviation when changing between the upward state and the upward state state.

In some embodiments, the linkage structure 7 is movably connected with the cleaning performing device 1 and the fixing structure, and the linkage structure 7, the cleaning performing device 1 and the fixing structure form a multi-linkages structure.

Further, the linkage structure 7 includes a first connecting rod 71 located on an upper side of the linkage structure 7 and a second connecting rod 72 located on a lower side of the linkage structure 7. Both ends of the first connecting rod 71 are hinged to the cleaning performing device 1 and the fixing structure, respectively, both ends of the second connecting rod 72 are hinged to the cleaning performing device 1 and the fixing structure respectively, and the multi-linkages structure is a parallelogram linkage structure. With this technical mean, the cleaning performing device 1 can be constrained to move up and down reliably in a swinging manner.

In some embodiments, a connecting position of the cleaning performing device 1 and the first connecting rod 71 is vertically opposite to a connecting position of the cleaning performing device 1 and the second connecting rod 72. A connecting position of the fixing structure and the first connecting rod 71 is exactly opposite to a connecting position of the fixing structure and the second connecting rod 72 in a vertical direction. Through this technical mean, the cleaning performing device 1 can maintain a same posture during moving up and down to avoid a skew.

Of course, the linkage structure 7 is not limited to the above-mentioned form, the linkage structure 7 can be other structure as long as it can constrain the cleaning performing device 1 to move up and down stably. Specifically, in the case where the cleaning driving module 12 of the cleaning performing device 1 includes a transmitting box 123, the linkage structure 7 may be connected to the transmitting box 123. In order to facilitate the connection of the linkage structure 7 and the transmitting box 123, the transmitting box 123 may have a mounting part 1231 protruded from a side of the transmitting box 123. Of course, a manner of connecting the linkage structure 7 to the cleaning performing device 1 is not limited, as long as the manner can play a role in constraining the position of the cleaning performing device 1 during moving up and down. In some embodiments, the cleaning assembly further includes an elastic structure (not shown) acting on the linkage structure 7. When the cleaning performing device 1 moves upward, the elastic structure stores an elastic potential energy, and when the cleaning performing device moves downward, the elastic structure releases the elastic potential energy. In this way, when the cleaning apparatus cleans the ground, etc., the cleaning apparatus may float on the uneven ground, and have a shock absorption effect at the same time.

It should be noted that the driving device 2 may also act on the linkage structure 7, and may be configured to drive the cleaning performing device 1 to move up and down through the linkage structure 7.

In some other embodiments, the constraining structure may include a swinging arm, one end of the swinging arm is connected with the cleaning performing device 1, and the other end of the swinging arm is rotatably connected to a fixing structure. During the cleaning performing device 1 moving up and down, the swinging arm is configured to swing to constrain a trajectory of the cleaning performing device 1 to swing up and down. The driving device 2 may also be configured to bring the cleaning performing device 1 to move up and down through driving the swinging arm.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 4:
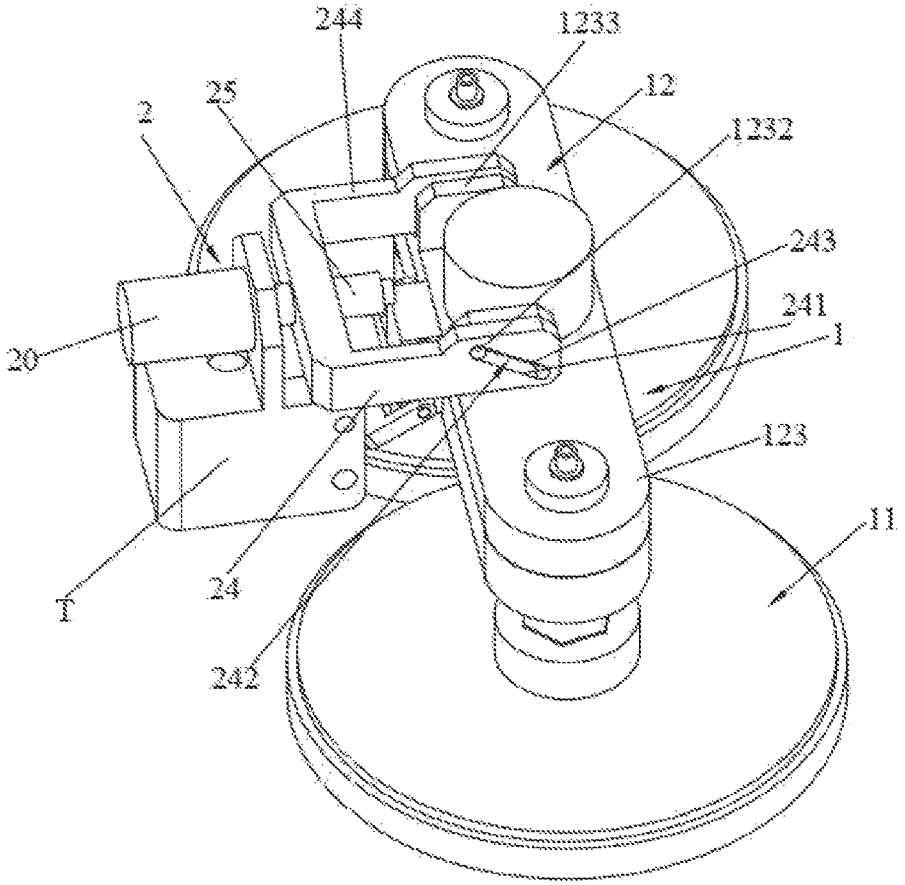
FIG. 4 is a structural diagram of a cleaning assembly according to an embodiment of this disclosure.

Please referring to FIG. 4, In some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIG. 3, which will not be repeated here.

In one embodiment, the driving device 2 includes a power source 20 and a transmitting mechanism, and the transmitting mechanism is connected between the power source 20 and the cleaning performing device 1 to transmit motion. The driving device 2 includes a moving member 24 driven by the power source 20 to perform a reciprocating linear movement. The moving member 24 includes a first sliding part, and the cleaning performing device 1 includes a second sliding part slidably matched to the first sliding part. When the moving member 24 moves in a first direction, the first sliding part is configured to move upward relative to the second sliding part along a direction angled with the first direction under constraints of the constraining structure. Through the cooperation between the first sliding part on the moving member 24 and the second sliding part on the cleaning performing device 1, the cleaning performing device 1 may move up and down under an action of the power source 20. It should be noted that the constraining structure may be configured to constrain a movement up and down of the cleaning performing device 1 with a fixed trajectory, but the trajectory of the cleaning performing device 1 is not limited to this.

In some embodiments, the first sliding part includes a first sliding surface 241, the second sliding part includes a first protruding portion 1232. When the first sliding surface 241 moves in the first direction, the first protruding portion 1232 slides along the first sliding surface 241 to generate an upward movement along a direction angled with the first direction.

Further, the moving member 24 defines a first sliding groove 242, and the first sliding groove 242 includes a first sliding surface 241 and a third sliding surface 243 opposite to the first sliding surface 241 along an extending direction of the first sliding groove 242. The first protruding portion 1232 is slidably arranged in the first sliding groove 242. When the third sliding surface 243 moves in a second direction opposite to the first direction, the first protruding portion 1232 slides along the third sliding surface 243 to generate a downward movement along a direction angled with the second direction. The first protruding portion 1232 is slidably arranged in the first sliding groove 242, for improving a reliability cooperation of the first protruding portion 1232 and the first sliding groove 242.

In an exemplary embodiment, the cleaning performing device 1 includes a transmitting box 123, and the transmitting box 123 is protruded with two opposite protruding plates 1233 protruding upward, and the two protruding plates 1233 are respectively provided with a first protruding portion 1232 protruded outward. The moving member 24 includes two opposite side plates 244, and the two side plates 244 define a first sliding groove 242 corresponding to the first protruding portion 1232. Of course, the first protruding portion 1232 and the first sliding groove 242 are not limited to the above-mentioned forms.

Of course, the first sliding part and the second sliding part are not limited to the above-mentioned forms. For example, the first sliding part may include a second protruding portion, and the second sliding part includes a second sliding surface. When the second protruding portion moves along the first direction, the second protruding portion moves on the second sliding surface, and the second sliding surface moves upwards along a direction angled with the first direction. Further, the cleaning performing device defines a second sliding groove, the second sliding groove includes the second sliding surface and a fourth sliding surface opposite to the second sliding surface along an extending direction of the second sliding groove, and the second protruding portion is slidably arranged in the second sliding groove. When the second protruding portion moves in the second direction opposite to the first direction, the second protruding portion moves on the fourth sliding surface, and the fourth sliding surface moves downward along a direction angled with the second direction. Alternatively, the first sliding part and the second sliding part may also be a cam and a cam mating surface, respectively.

In some embodiments, an output end of the power source 20 is connected with a screw rod 25 threadedly connected with the moving member 24. When the screw rod 25 rotates under a driving of the power source 20, the moving member 24 may be driven to perform a reciprocating linear movement (In some instances, a linear movement in a horizontal direction), and the first sliding part, moves correspondingly relative to the second sliding part. So that the cleaning performing device 1 moves up and down. The moving member 24 may have a single-piece structure or may be a combination of at least two structures. For example, the moving member 24 may include a main structure and a screw nut fixedly connected to the main structure, and the moving member 24 is matched to the screw rod 25 through the screw nut.

It can be understood that the linear reciprocating movement of the moving member 24 is not limited to be caused by a transmission of the screw rod 25, any feasible technical means may be suitable as long as the linear reciprocating movement of the moving member 24 can be realized.

In some embodiments, the power source 20 may be installed on a fixing base T, and the fixing base T can be integrally formed in the body of the cleaning apparatus, or may be fixedly connected to the body directly or indirectly.

It should be noted that a cooperation of the first sliding part and the second sliding part may also be applied to the linkage structure 7, and the cleaning performing device 1 is driven by the linkage structure 7 to enable the cleaning performing device 1 to move up and down.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 5:
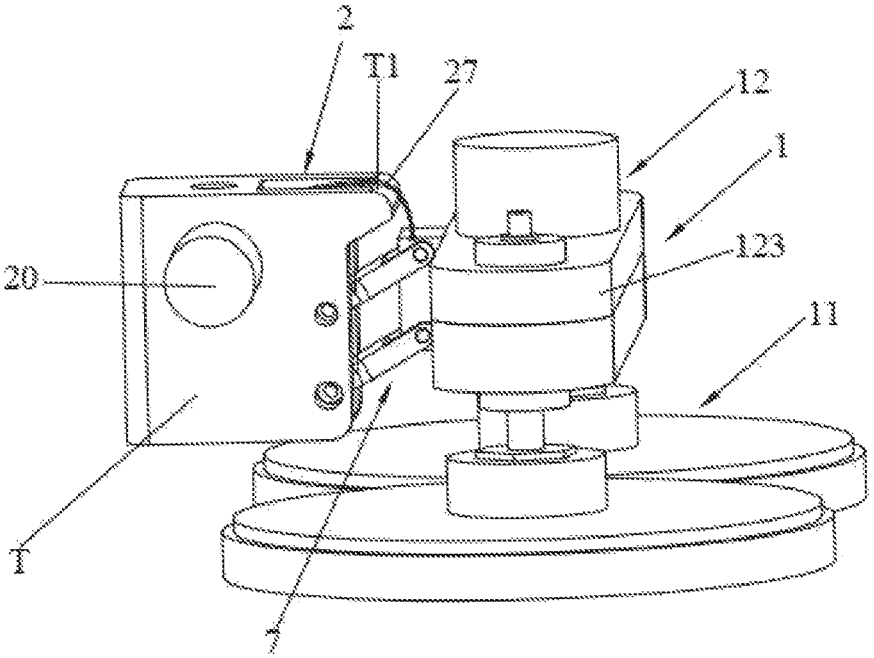
FIG. 5 is a structural diagram of a cleaning assembly according to an embodiment of this disclosure.
Figure 6:
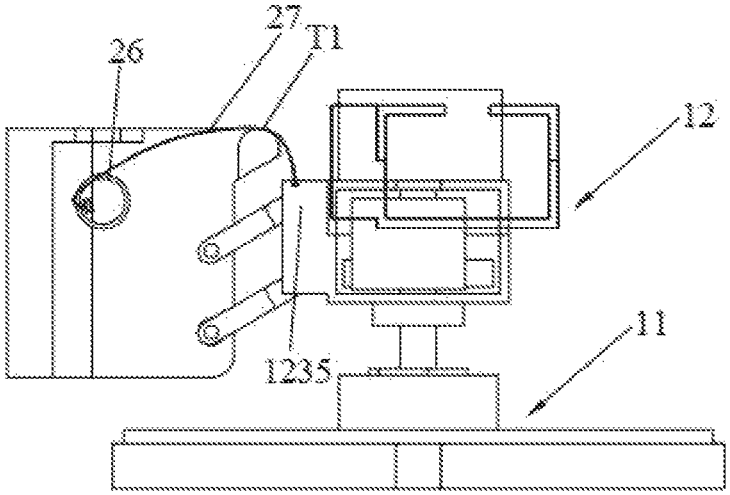
FIG. 6 is a cross-sectional view of the cleaning assembly in FIG. 5.

Please referring to FIG. 5 and FIG. 6, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIG. 3, and the constraining structure also adopts a linkage structure 7, which will not be repeated here.

In some embodiments, the driving device 2 includes a power source 20 and a transmitting mechanism, and the transmitting mechanism is arranged between the power source 20 and the cleaning performing device 1. The transmitting mechanism includes a winding mechanism, and the winding mechanism includes a winding wheel 26 driven by the power source 20 and a winding belt 27 connected to the winding wheel 26. One end of the winding belt 27 away from the winding wheel 26 is connected to the cleaning driving module 12. When rotating in the first direction, the winding belt 27 is continuously wound on the winding wheel 26, and the winding belt 27 is configured to pull the cleaning driving module 12 to move upward under constraints of the constraining structure. When rotating in the second direction opposite to the first direction, the winding belt 27 is loosen from the winding wheel 26, and the cleaning performing device 1 falls back under the constraints of the constraining structure. By winding the winding belt 27 on the winding wheel 26, loosening the winding belt 27 from the winding wheel 26, and combining the constraints of the constraining structure, the cleaning performing device 1 may move up and down stably.

It should be noted that the winding belt 27 may be directly connected with the cleaning driving module 12, or can be indirectly connected with the cleaning driving module 12. When indirectly connected with the cleaning driving module 12, the winding belt 27 may isolate a vibration, for reducing an influence of a rotation or movement in other forms of the cleaning module 11 relative to the ground.

In some embodiments, the power source 20 is arranged on a fixing base T, and the winding wheel 26 is directly connected to an output end of the power source 20. The fixing base T may be integrally formed in the body of the cleaning apparatus, or may be fixedly connected to the body directly or indirectly.

In order to guide a movement of the winding belt 27, a guiding portion T1 is arranged on the fixing base T, so that when the winding belt 27 is wound on the guiding portion T1, the winding belt 27 can be guided in different directions, effect. Of course, the above solution is only an exemplary solution and should not be taken as a limitation. For example, a structure for guiding the movement of the winding belt 27 may not be provided between the winding wheel 26 and the cleaning driving module 12, or a guiding wheel may be provided, etc.

The power source 20 may be, but is not limited to, a motor.

In some embodiments, the cleaning driving module 12 includes a transmitting box 123, and the winding belt 27 and the linkage structure 7 are both connected to the transmitting box 123. In a specific example, in order to arrange the winding belt 27 and the linkage structure 7 conveniently, a side of the transmitting box 123 is protruded with a mounting portion 1235, the mounting portion 1235 may be integrally formed in the transmitting box 123 or fixedly connected to the transmitting box 123.

It should be noted that, in the embodiment, the winding belt 27 should not be interpreted in a narrow sense, a windable flexible structure, such as, a rope, or a belt, etc., may be regarded as the winding belt 27.

It should be noted that the winding structure may also act on the linkage structure 7, and may be configured to drive the cleaning performing device 1 to move up and down through the linkage structure 7.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 7:
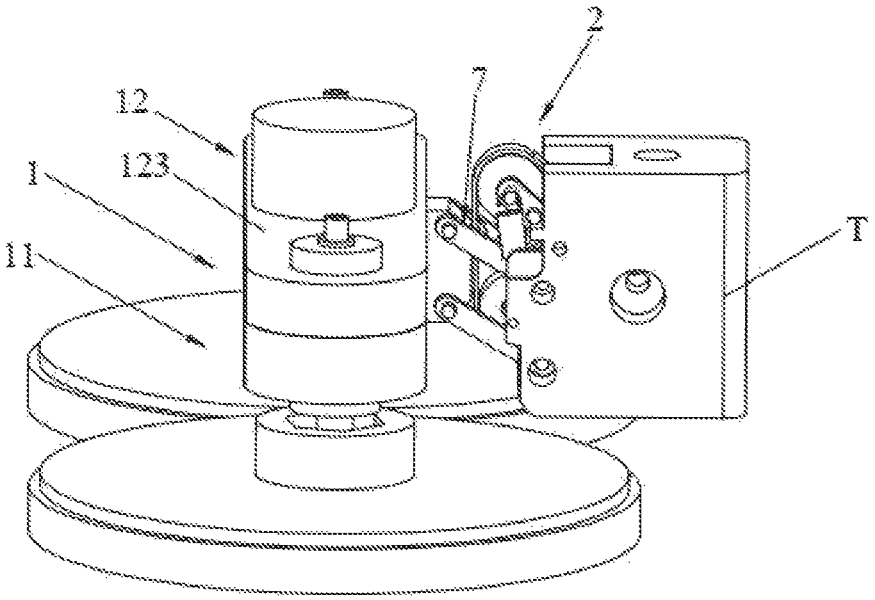
FIG. 7 is a structural diagram of a cleaning assembly according to an embodiment of this disclosure.
Figure 8:
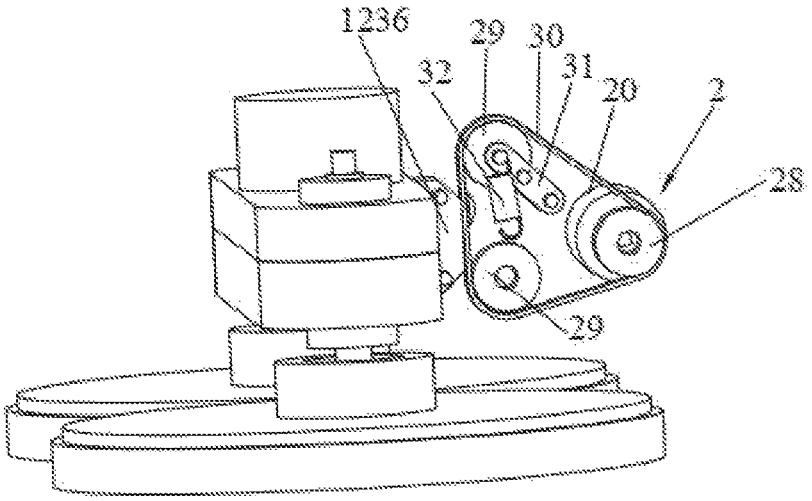
FIG. 8 is a structural diagram of some parts of the cleaning assembly in FIG. 7.

Please referring to FIGS. 7 and 8, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIG. 3, and the constraining structure also adopts a linkage structure 7, which will not be repeated here.

In some embodiments, the driving device 2 includes a power source 20 and a transmitting mechanism, and the transmitting mechanism is connected between the power source 20 and the cleaning performing device 1 to transmit motion. The transmitting mechanism includes a driving wheel 28 driven by the power source 20, at least one driven wheel 29, and a transmitting belt 30 wound on the driving wheel 28 and the driven wheel 29. When the driving wheel 28 rotates, the transmitting belt 30 is driven to move around the driving wheel 28 and the driven wheel 29. A position of the transmitting belt 30 is connected to the cleaning performing device 1. When the driving wheel 28 rotates in the first direction, the transmitting belt 30 is configured to move to drive the cleaning performing device 1 to move upward. When the driving wheel 28 rotates in the second direction, the transmitting belt 30 is configured to move to drive the cleaning performing device 1 to move downward. With the cooperation of the driving wheel 28, the driven wheel 29, and the transmitting belt 30, the cleaning performing device 1 may move up and down stably.

In some embodiments, the transmitting mechanism includes at least two driven wheels 29, the transmitting mechanism also includes a movable tensioning structure, one of the at least two driven wheels 29 is installed on the tensioning structure to enable the tensioning structure to have a tensioning effect. During the cleaning performing device 1 moving up and down with a fixed trajectory driven by the transmitting belt 30, positions of the transmitting belt 30, the driven wheel 29 with the tensioning function, and the tensioning structure may be adaptively changed according to a change of a movement trajectory of the cleaning performing device 1 under constraints of the constraining structure. Under an action of the tensioning structure, the driven wheel 29 with the tensioning effect is configured to remain the transmitting belt 30 in a tensioned state. As the positions of the transmitting belt 30, the driven wheel 29 with the tensioning function, and the tensioning structure may be adaptively changed according to the change of the movement trajectory of the cleaning performing device 1, and under the action of the tensioning structure, the transmitting belt 30 can be kept in the tensioned state, so that the cleaning performing device 1 can move up and down under the constraints of the constraining structure.

Further, the tensioning structure includes a tensioning arm 31 and an elastic element 32, one end of the tensioning arm 31 is hinged to a fixing structure, and the driven wheel 29 with the tensioning effect is installed on the other end of the tensioning arm 31, and the elastic piece 32 is connected between the tensioning arm 31 and another fixing structure. During the cleaning performing device 1 moving up and down driven by the drive belt 30, in order to adapt to the change of the movement track of the cleaning performing device 1, the driven wheel 29 with the tensioning effect and the tensioning arm 31 may rotate. Under the action of the elastic element 32, the transmitting belt 30 may be kept in the tensioned state so as to be drive the cleaning performing device 1 to move up and down reliably.

It should be noted that the transmitting belt 30 in the embodiment should not be interpreted in a narrow sense, and any belt-like or similar structures that can be driven by the driving wheel 28 and the driven wheel 29 may be regarded as the transmitting belt 30. For example, the transmitting belt 30 may be a belt, a rope, a chain, or the like.

Further, the power source 20, the driving wheel 28, the driven wheel 29 and the tensioning structure are arranged on a fixing base T. The fixing base T may be integrally formed in the body of the cleaning apparatus, or may be fixedly connected to the body directly or indirectly.

The power source 20 may be, but is not limited to, a motor.

In some embodiments, the cleaning driving module 12 includes a transmitting box 123, and the linkage structure 7 and the transmitting belt 30 are both connected to the transmitting box 123. In a specific example, in order to conveniently arrange the transmitting belt 30 and the linkage structure 7, the transmitting box 123 is arranged with a mounting portion 1236 protruded from a side of the transmitting box 123. The transmitting belt 30 is fixedly connected to the mounting portion 1236 by a screw.

It should be noted that a manner of driving by the transmitting belt 30 may also be applied to the linkage structure 7, and the cleaning performing device 1 is driven by the linkage structure 7 to move up and down.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 9:
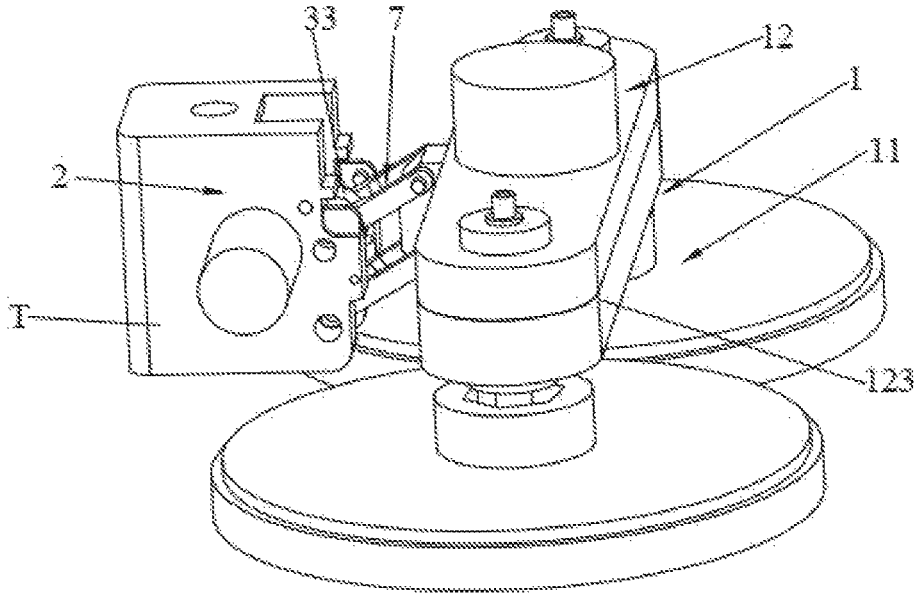
FIG. 9 is a structural diagram of a cleaning assembly according to an embodiment of this disclosure.
Figure 10:
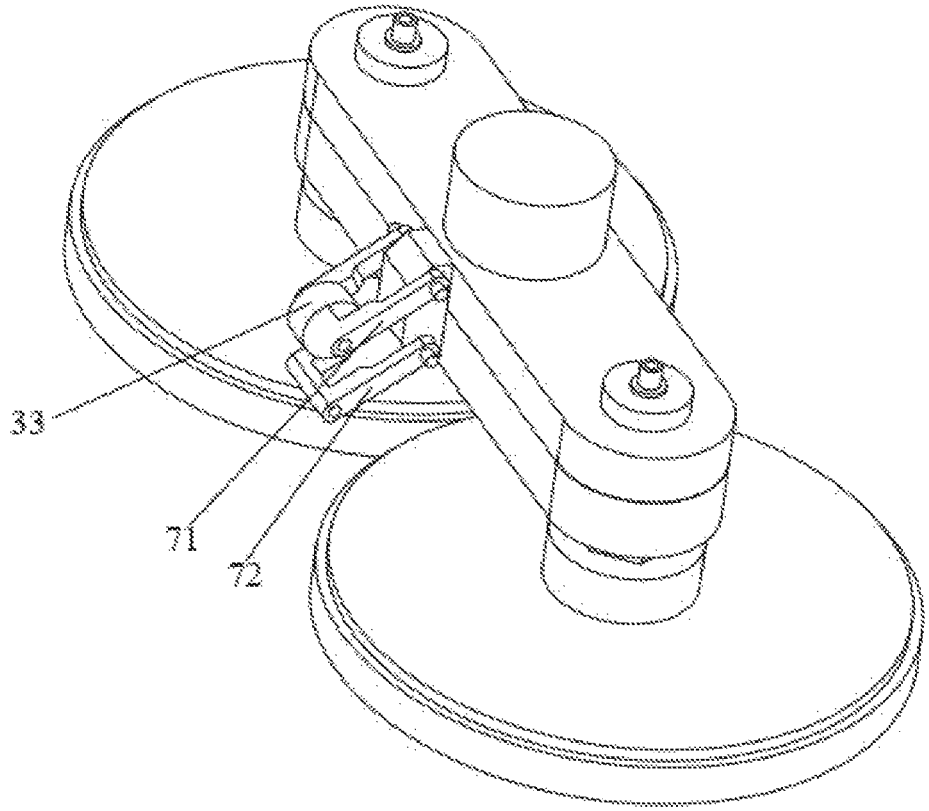
FIG. 10 is a structural diagram of some parts of the cleaning assembly in FIG. 9.

Please referring to FIGS. 9 and 10, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIG. 3, and the constraining structure also adopts the linkage structure 7, which will not be repeated here. The driving device 2 is configured to drive the linkage structure 7 to bring the cleaning performing device 1 to move. That is to say, the linkage structure 7 can not only play the role of driving the cleaning performing device 1, but also can play the role of constraining the position of the cleaning performing device 1 during moving up and down.

In some embodiments, the linkage structure 7 includes a first connecting rod 71 located on an upper side of the linkage structure 7 and a second connecting rod 72 located on a lower side of the linkage structure 7, and both ends of the first connecting rod 71 are hinged to the cleaning performing device 1 and fixing structure respectively, both ends of the second connecting rod 72 are hinged to the cleaning performing device 1 and the fixing structure respectively, and the first connecting rod 71, the second connecting rod 72, the cleaning performing device 1 and the fixing structure form a parallelogram linkage structure. The driving device 2 includes the power source 20 and the transmitting mechanism. The transmitting mechanism includes a rotating wheel 33. The rotating wheel 33 is fixedly connected to the first connecting rod 71 or the second connecting rod 72, and has a same rotation center as the first connecting rod 71 or the second connecting rod 72 to drive the first connecting rod 71 or the second connecting rod 72 to swing around a hinged position between the fixing structure and the first connecting rod 71 or between the fixing structure and the second connecting rod 72, so as to drive the cleaning performing device 1 to swing up and down. The "rotating wheel 33" here may be a gear, a worm gear, or the like, and may be directly or indirectly connected with the power source 20. The rotating wheel 33 is not limited to be connected to the first connecting rod 71 or the second connecting rod 72 in the manner as described above.

Further, the power source 20, the linkage structure 7 and other structures are arranged on a fixing base T, and the fixing base T may be integrally formed in the body of the cleaning apparatus, or may be fixedly connected to the body directly or indirectly.

In addition, when the linkage structure 7 is driven by the rotating wheel 33, the linkage structure 7 may also be in other forms.

It should be noted that when the lifting drive device 2 drives the linkage structure 7 to bring the cleaning performing device 1 to move through the linkage structure 7, the transmitting mechanism can also be in various other possible forms, such as other implementation solutions in other embodiments.

Figure 12:
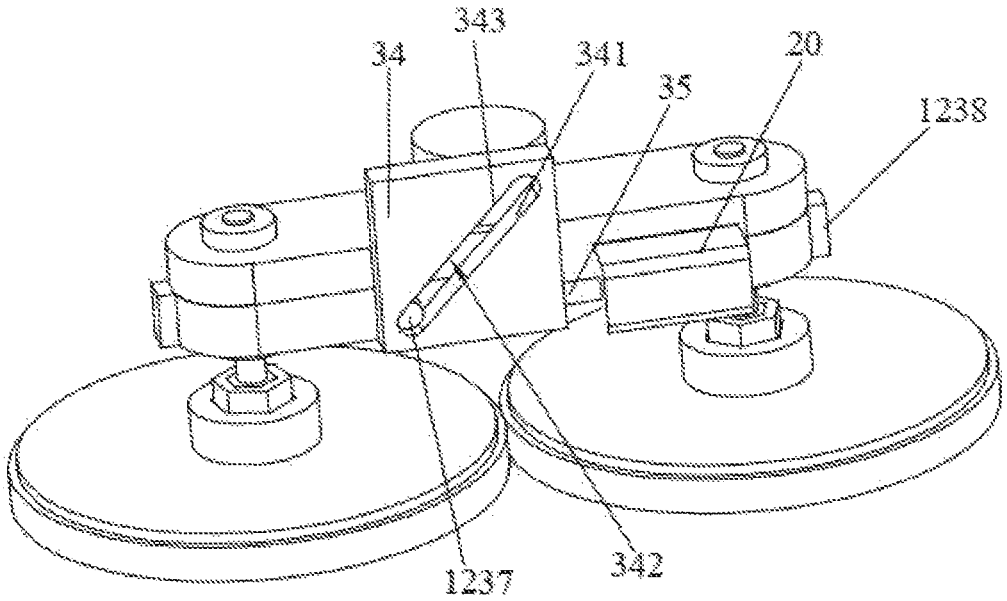
FIG. 12 is a structural diagram of some parts of the cleaning assembly in FIG. 11.
Figure 13:
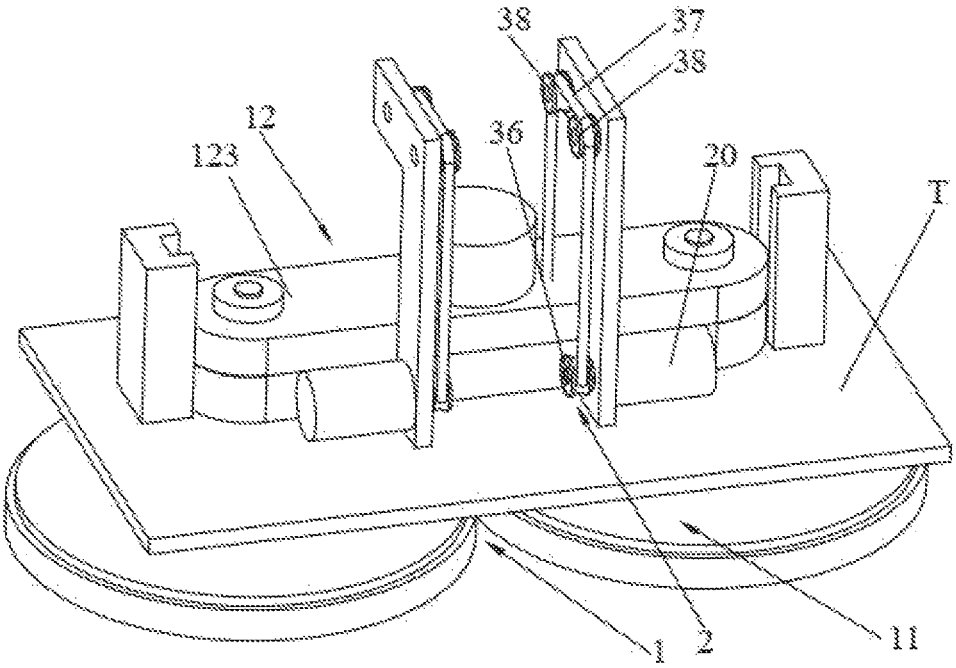
FIG. 13 is a structural diagram of a cleaning assembly according to an embodiment of this disclosure.

Please referring to FIGS. 12 and 13, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 is basically the same as the cleaning performing device 1 as shown in FIG. 3, which will not be repeated here.

In some embodiments, the driving device 2 includes a power source 20 and a transmitting mechanism, and the transmitting mechanism is connected between the power source 20 and the cleaning performing device 1 to transmit motion. The transmitting mechanism includes a moving member 34 driven by the power source 20 to perform a reciprocating linear movement. The moving member 34 includes a first sliding part, and the cleaning performing device 1 includes a second sliding part matched with the first sliding part. When the moving member 34 moves in the first direction, the first sliding part slides relative to the second sliding part, and the second sliding part moves upward along a direction angled with the first direction under the constraints of the constraining structure. Through the cooperation between the first sliding part on the moving member 34 and the second sliding part on the cleaning performing device 1, the cleaning performing device 1 can move up and down under the action of the power source 20. It should be noted that the constraining structure can constrain a movement up and down of the cleaning performing device 1 with the fixed trajectory, but it is not limited to this.

In some embodiments, the first sliding part includes a first sliding surface 341, the second sliding part includes a first protruding portion 1237. When the first sliding surface 341 moves in the first direction, the first protruding portion 1237 slides along the first sliding surface 341 upward in a direction angled with the first direction.

Further, the moving member 34 defines a first sliding groove 342, the first sliding groove 342 includes a first sliding surface 341 and a third sliding surface 343 opposite to the first sliding surface 341 along an extending direction of the first sliding groove 342. The first protruding portion 1237 is slidably received in the first sliding groove 342. When the third sliding surface 343 moves in the second direction opposite to the first direction, the first protruding portion 1237 slides along the third sliding surface 343 to move downward along a direction angled with the second direction. The first protruding portion 1237 is slidably disposed in the first sliding groove 342, which is beneficial to mating the first protruding portion 1237 with the first sliding groove 342 reliably.

In some embodiments, the cleaning performing device 1 includes a transmitting box 123, and the transmitting box 123 is provided with a first protruding portion 1237 protruded from a side of the transmitting box 123. Of course, the first protruding portion 1237 is not limited to the specific manner.

Of course, the first sliding part and the second sliding part are not limited to the above-mentioned forms. For example, the first sliding part includes a second protruding portion, the second sliding part includes a second sliding surface. The second protruding portion moves in the first direction, and the second sliding surface moves upward in a direction angled with the first direction. Further, the cleaning performing device defines a second sliding groove, the second sliding groove includes a second sliding surface and a fourth sliding surface opposite to the second sliding surface along an extending direction of the second sliding groove, and the second protruding portion is slidably arranged in the second sliding groove. When the protruding portion moves in the second direction opposite to the first direction, the fourth sliding surface moves downward in a direction angled with the second direction. Alternatively, the first sliding part and the second sliding part may also be a cam and a cam mating surface, respectively.

In some embodiments, an output end of the power source 20 is connected with a screw rod 35, and the screw rod 35 is threadedly connected with the moving member 34. When the screw rod 35 rotates under the driving of the power source 20, the moving member 34 may be driven to perform the reciprocating linear movement (In some instances a linear movement in the horizontal direction), the first sliding part moves relative to the second sliding part correspondingly, so that the cleaning performing device 1 moves up and down. The moving member 34 may be a single-piece structure or a combination of at least two structures. For example, the moving member 34 may include a main structure and a screw nut fixedly connected to the main structure, and the moving member 24 is matched to the screw rod 25 through the screw nut.

It can be understood that the linear reciprocating movement of the moving member 34 is not limited to be transmitted by the screw rod 35, and the screw rod 35 can be replaced by other structure which can enable the moving member 34 to perform the linear reciprocating movement.

In some embodiments, the power source 20 may be installed on a fixing base T, and the fixing base T may be integrally formed in the body of the cleaning apparatus, or may be fixedly connected to the body directly or indirectly.

In some embodiments, the constraining structure includes a first structure arranged on the cleaning performing device 1 and a second structure having a fixing structure, the first structure is matched with the second structure. During the cleaning performing device 1 moving up and down, the first structure moves up and down relative to the second structure, and the second structure is configured to constrain the position of the first structure during moving up and down. During the cleaning performing device 1 moving up and down, the first structure is regarded as a component of the cleaning performing device 1 or as a structure fixedly connected to the cleaning performing device 1, and moves up and down relative to the second structure. During the first structure moving up and down, the second structure can constrain the position of the first structure during moving up and down, thus enabling the cleaning performing device 1 to move stably.

In some embodiments, the first structure is slidably matched with the second structure to guide the up and down movement of the cleaning performing device 1. Of course, the first structure is not limited to slidably matched with the second structure. For example, during the first structure moving up and down, the second structure does not necessarily contact with the first structure, and the second structure may constrain a possible deviation of the first structure within a certain range. Alternatively, the first structure or the second structure is used as a component of the transmitting mechanism, and moves under the driving of the power source 20, so that the first structure moves up and down under the action of the second structure, so that the cleaning performing device 1 moves up and down, and the second structure may constrain the position of the first structure in the up and down movement. By the above technical means, the functions of moving up and down and constraining the position of the cleaning performing device 1 are simultaneously achieved by a set of structures, no need to arrange the driving device 2 additionally. For example, the first structure is engaged with the second structure, and during the cleaning performing device 1 moving, up and down, the first structure remains to be engaged with the second structure to guide the cleaning performing device 1 to move up and down. For example, the first structure may include a gear, the second structure may include two racks with fixing structures that are engaged with both sides of the gear respectively. The power source 20 is fixedly connected to the cleaning performing device, and directly or indirectly drives the gear. Under the driving of the power source 20, the gear can move up and down along the two racks, to bring the cleaning performing device 1 and the power source 20 to move up and down. For another example, the first structure may include two oppositely arranged racks, the second structure may include a gear, the two racks are engaged on two opposite sides of the gear, the gear is directly or indirectly connected to the power source 20, and the gear is driven by the power source 20 to bring the two racks and the cleaning performing device to move up and down. During the up and down movements of the racks, the positions of the two racks can be constrained by the gear, and then the position of the cleaning performing device 1 during moving up and down can be constrained. Of course, when the first structure is engaged with the second structure, the first structure or the second structure is not limited to be used as a component of the transmitting mechanism to drive the cleaning performing device to move up and down, or the first structure or the second structure may not be used as a component of the transmitting mechanism. For example, the gear in the above example may drive the cleaning performing device to move without the driving of the power source 20, and the cooperation of the gear and the racks is configured to guide the cleaning performing device to move up and downward, not to drive the cleaning performing device.

In some embodiments, the first structure is a protruding portion 1238 arranged on the cleaning performing device 1, the second structure is a limiting groove 8 provided on a fixing structure, and the protruding portion 1238 is received in the limiting groove 8. When the cleaning performing device 1 moves up and down, the protruding portion 1238 can move up and down in the limiting groove 8, and inner walls of the limiting groove 8 can limit the position of the protruding portion 1238 during moving up and down. Further, the limiting groove 8 may be a sliding groove, and the protruding portion 1238 moves up an down (such as moves upward vertically) along a fixed track under the restriction of the sliding groove. Of course, the protruding portion 1238 does not have to be strictly limited by the limiting groove 8. For example, a width of the limiting groove 8 may be greater than a width of the protruding portion 1238, and the inner walls of the limiting groove 8 can limit a deviation range of the protruding portion 1238 during moving up and down. The fixing structure may be a fixing base T.

When the first structure is slidably matched with the second structure, the matching manner is not limited to a matching of the protruding portion 1238 and the sliding groove, and may include any guiding and sliding mode. For example, the matching manner may include a matching manner of the sliding groove and the sliding wheel, and a matching manner of the sliding groove and the sliding surface, a matching manner of a shaft and a shaft sleeve, and so on.

In some embodiments, the cleaning driving module 12 of the cleaning performing device 1 includes a transmitting box 123, and the first structure is protruded outward from the transmitting box 123. Of course, the structure of the cleaning driving module 12 is not limited to this.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Please referring to FIG. 13, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, during moving up and down, the position of the cleaning performing device 1 can be constrained by the constraining structure, such that improves a stability of the cleaning performing device 1 during moving up and down.

Figure 11:
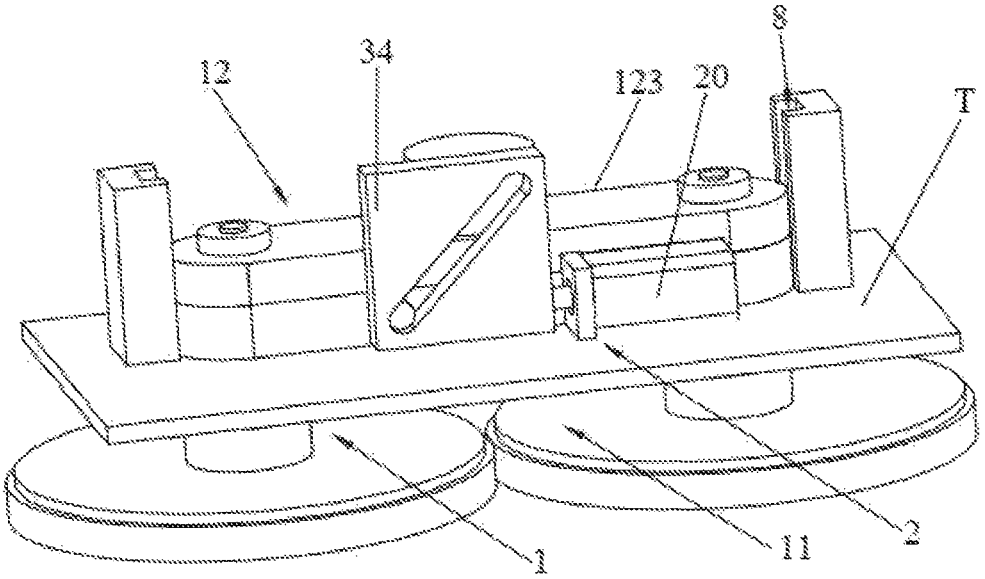
FIG. 11 is a structural diagram of a cleaning assembly according to an embodiment of this disclosure.

In some embodiments, the cleaning performing device 1 and the constraining structure are basically the same as the cleaning performing device 1 and the constraining structure as shown in FIGS. 11 and 12, which will not be repeated here.

In some embodiments, the driving device 2 includes a power source 20 and a transmitting mechanism, and the transmitting mechanism is connected between the power source 20 and the cleaning performing device 1 to transmit motion. The transmitting mechanism includes a winding wheel 36 driven by the power source 20 and a winding belt 37 connected with the winding wheel 36. One end of the winding belt 37 away from the winding wheel 36 is connected to the cleaning driving module 12. When the winding wheel 36 rotates in the first direction, the winding belt 37 is continuously wound to the winding wheel 36, and the winding belt 37 pulls the cleaning driving module 12 to move upward under the constraints of the constraining structure. When the winding wheel 36 rotates in the second direction opposite to the direction, the winding belt 37 becomes loose, and the cleaning performing device 1 falls back under the constraints of the constraining structure. By winding the winding belt 37 on the winding wheel 36, loosening the winding belt 37 from the winding wheel 36, and combining the constraints of the constraining structure, the cleaning performing device 1 may move up and down stably.

It should be noted that the winding belt 37 may be directly connected with the cleaning driving module 12, or can be indirectly connected with the cleaning driving module 12. When indirectly connected with the cleaning driving module 12, the winding belt 37 may isolate a vibration, for reducing an influence of a rotation or movement in other forms of the cleaning module 11 relative to the ground.

In some embodiments, the power source 20 is arranged on a fixing base T, and the winding wheel 36 is directly connected to an output end of the power source 20. The fixing base T may be integrally formed in the body of the cleaning apparatus, or may be fixedly connected to the body directly or indirectly.

In order to guide a movement of the winding belt 37, a guide wheel 38 is arranged between the winding wheel 36 and the cleaning driving module 12, and the winding belt 37 is wound on the guide wheel 38, and the winding belt 37 can be guided in different directions. Of course, the above solution is only an exemplary solution and should not be taken as a limitation. For example, a structure for guiding the movement of the winding belt 37 may not be provided between the winding wheel 36 and the cleaning driving module 12.

The power source 20 may be, but is not limited to, a motor.

In some embodiments, the cleaning driving module 12 includes a transmitting box 123, and the winding belt 37 is connected to the transmitting box 123.

It should be noted that, the winding belt 37 in the embodiment should not be interpreted in a narrow sense, a windable flexible structure, such as, a rope, or a belt, etc., may be regarded as the winding belt 37.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 14:
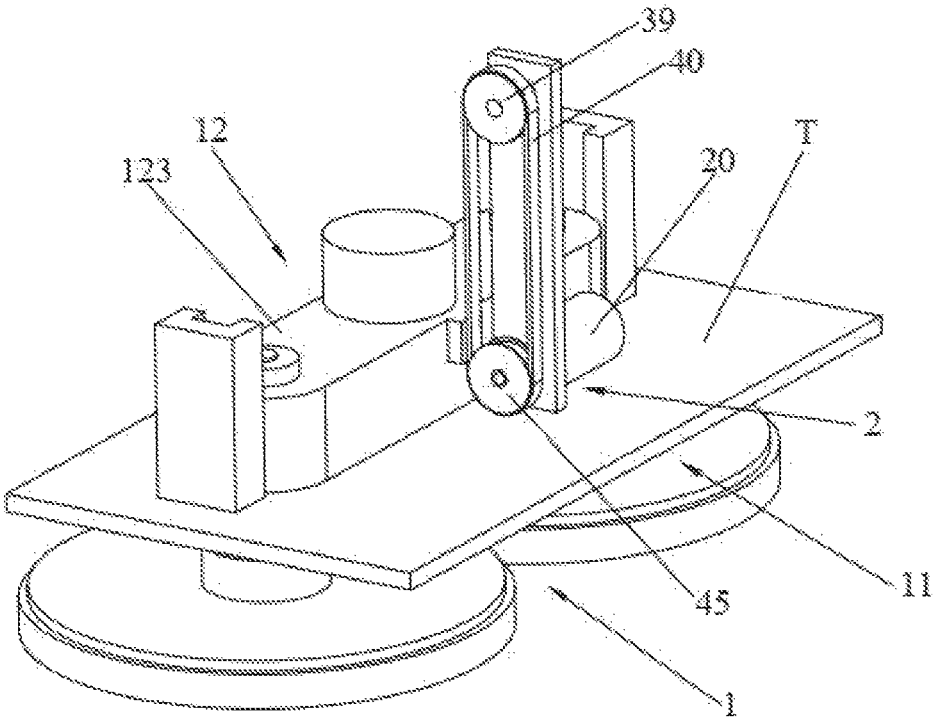
FIG. 14 is a structural diagram of a cleaning assembly according to an embodiment of this disclosure.

Please referring to FIG. 14, In some embodiments the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, during moving up and down, the position of the cleaning performing device 1 can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIGS. 11 and 12, which will not be repeated here.

In some embodiments, the driving device 2 includes a power source 20 and a transmitting mechanism, and the transmitting mechanism is connected between the power source 20 and the cleaning performing device 1 to transmit motion. The transmitting mechanism includes a driving wheel 45 driven by the power source 20, at least one driven wheel 39, and a driving belt 40 wound on the driving wheel 45 and the driven wheel 39. When the driving wheel 45 rotates, the driving belt 40 is driven to move around the driving wheel 45 and the driven wheel 39. A position of the driving belt 40 is connected to the cleaning performing device 1. When the driving wheel 45 rotates in the first direction, the movement of the transmitting belt 40 can drive the driving belt 40 to move upward to bring the cleaning performing device 1 to move upward. When the driving wheel 45 rotates in the second direction, the movement of the transmitting belt 40 can drive the driving belt 40 to move downward to bring the cleaning performing device 1 to move downward. With the cooperation of the driving wheel 45, the driven wheel 39, and the transmitting belt 40, the cleaning performing device 1 can move up and down stably.

It should be noted that the transmitting belt 40 in the embodiment should not be interpreted in a narrow sense, and any belt-like or similar structures that can be driven by the driving wheel 45 and the driven wheel 39 can be regarded as the transmitting belt 40. For example, the transmitting belt 40 may be a belt, a rope, a chain, or the like.

Further, the power source 20, the driving wheel 45, and the driven wheel 39 are arranged on a fixing base T. The fixing base T may be integrally formed in the body of the cleaning apparatus, or may be fixedly connected to the body directly or indirectly.

The power source 20 may be, but is not limited to, a motor.

In some embodiments, the cleaning driving module 12 includes a transmitting box 123, and the transmitting belt 40 is connected to the transmitting box 123.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 15:
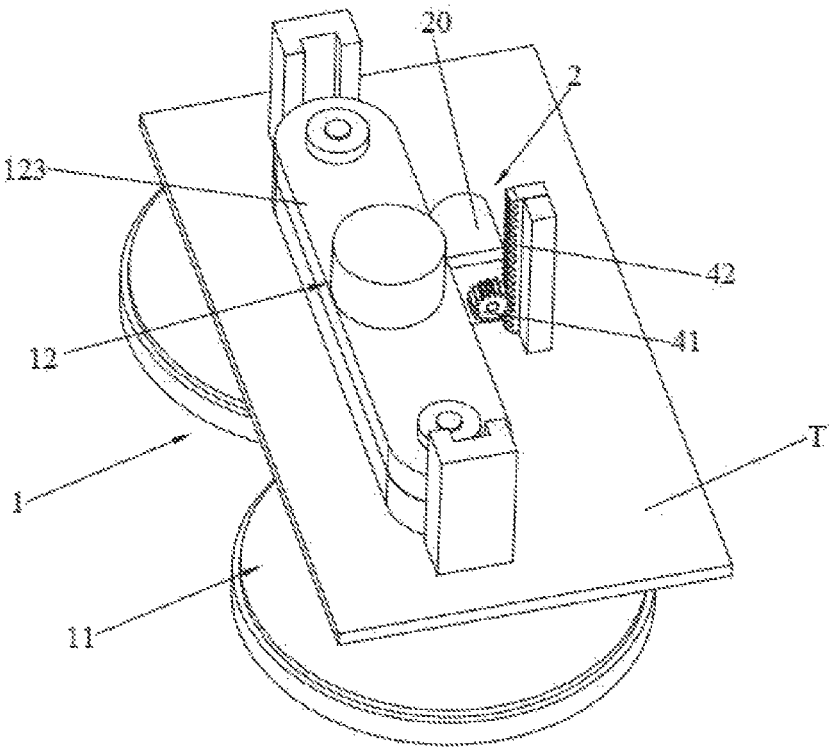
FIG. 15 is a structural diagram of a cleaning assembly according to an embodiment of this disclosure.

Please referring to FIG. 15, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, the position of the cleaning performing device 1 during moving up and down can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIGS. 11 and 12, which will not be repeated here.

In some embodiments, the driving device 2 includes a power source 20 and a transmitting mechanism connected with the power source 20 to transmit motion, the power source 20 is fixedly connected with the cleaning performing device 1. The transmitting mechanism includes a gear 41, the gear 41 is configured to engage with a fixed rack 42. The gear 41 rotates in the first direction and moves upward along the rack 42 to drive the driving device 2 and the cleaning performing device 1 to move upward. The gear 41 rotates in the second direction opposite to the first direction and moves downward along the rack 42 to drive the driving device 2 and the cleaning performing device 1 to move downward.

The form of the rack 42 is not limited, and the rack 42 may be a linear rack or a circular arc rack. the gear 41 and the rack 42 may have standard involute tooths, cycloidal tooths, or trochoid tooths.

In some embodiments, the rack 42 is arranged on a fixing base T. The fixing base T may be integrally formed in the body of the cleaning apparatus, or may be fixedly connected to the body directly or indirectly.

In order to ensure the reliability of the up and down movement of the cleaning performing device 1, the constraining structure may include other structures, or may be replaced by other structures with a trajectory constraining effect, in addition to the linkage structure 7 and the swinging arm. For example, the constraining structure may include other different structures having a trajectory constraining effect in other embodiments.

Figure 16:
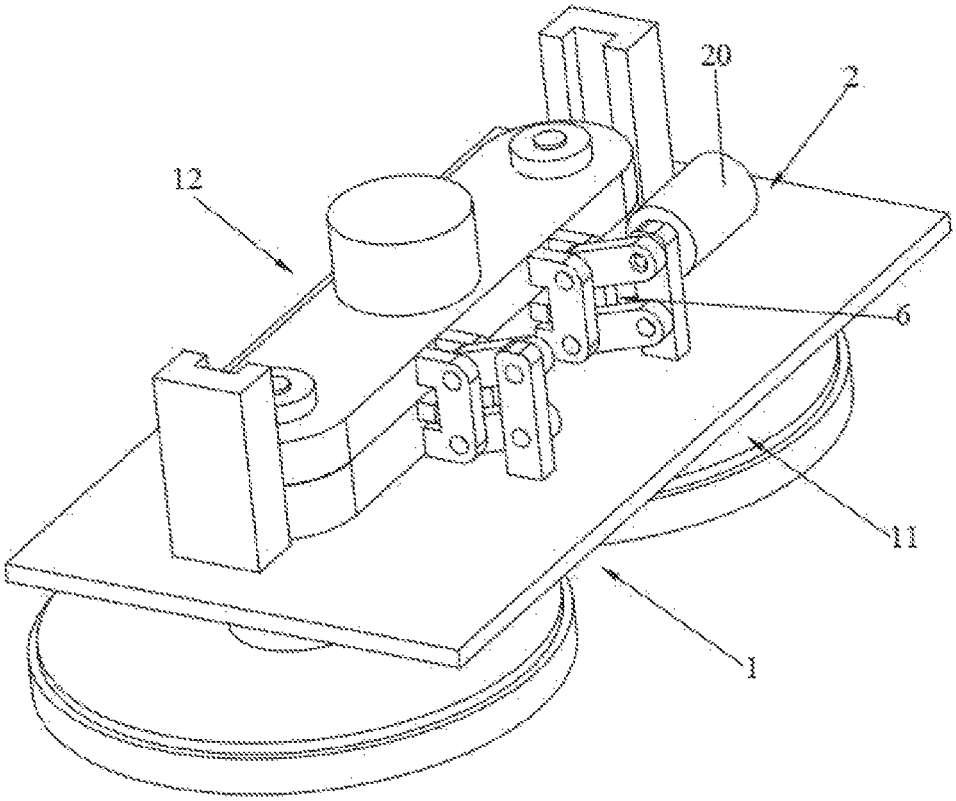
FIG. 16 is a structural diagram of a cleaning assembly according to an embodiment of this disclosure.

Please referring to FIG. 16, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning performing device 1 can move up and down under an action of the driving device 2 according to an actual need, such that improves an adaptability of the cleaning apparatus. Moreover, during moving up and down, the position of the cleaning performing device 1 can be constrained by the constraining structure, such that improves a stability of the cleaning performing device 1 during moving up and down.

In some embodiments, the cleaning performing device 1 and the constraining structure are basically the same as the cleaning performing device 1 and the constraining structure as shown in FIGS. 11 and 12, which will not be repeated here.

In some embodiments, an output end of the lifting drive device 2 is connected with a swing structure 6, and the swing structure 6 is connected with the cleaning performing device 1. Under a driving of the driving device 2, the swing structure 6 may drive the cleaning performing device 1 to swing up and down. Through a transmitting of the swing structure 6, the cleaning performing device 1 may move up and down stably.

In some embodiments, the swing structure 6 may be connected between the cleaning performing device 1 and the fixing structure, and the swing structure 6, the cleaning performing device 1 and the fixing structure may form a multi-linkages structure, such as a parallelogram linkage structure. The swing structure 6 may also be a swinging arm, and the swinging arm may be fixedly connected with the cleaning performing device 1 and configured to drive the cleaning performing device 1 to swing under the driving of the driving device 2.

In some embodiments, the swing structure 6 may not only play the role of driving the cleaning performing device 1, but also can play a role in constraining the position of the cleaning performing device 1 during the up and down movement.

In order to ensure the reliability of the up and down movement of the cleaning performing device 1, the constraining structure of the embodiment adopts the cooperation mode of the first structure and the second structure as shown in FIGS. 11 and 12 simultaneously.

Figure 17:
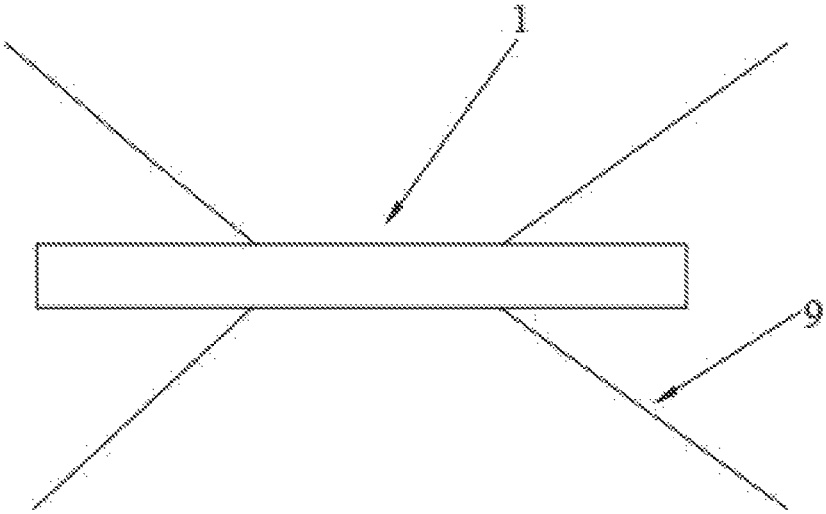
FIG. 17 is a structural diagram of a cleaning assembly according to an embodiment of this disclosure.

Please referring to FIG. 17, in some embodiments, the constraining structure includes a plurality of tension ropes 9, and one end of each of the plurality of tension ropes 9 is connected to the cleaning performing device 1 to tension the cleaning performing device 1 around. The tensions of the plurality of tension ropes 9 is configured to constrain the lifting or lowering trajectory of the cleaning performing device 1. With the constraints of the plurality of tension ropes 9, the position of the cleaning performing device 1 during moving up and down can be reliably constrained.

It should be noted that, in the present disclosure, the constraining structure is not limited to the implementations disclosed in the above embodiments. In addition, the constraining structure may also adopt at least two different forms of structures at the same time to jointly constrain the position of the cleaning performing device during the up and down movement. In addition, the driving device in the above embodiment is only an example, and the driving device can also have various other feasible ways. According to the actual need, the driving device can also act on the constraining structure and enable the cleaning performing device 1 to move up and down by the constraining structure.

Please referring to FIG. 18 to 24, in some embodiments, the cleaning assembly includes a cleaning performing device 1, a driving device 2, and a constraining structure. The cleaning performing device 1 includes a cleaning module 11 configured to clean a surface to be cleaned and a cleaning driving module 12 configured to drive the cleaning module 11 to move relative to the surface to be cleaned. The driving device 2 is configured to drive the cleaning performing device 1 to be lifted or lowered. The constraining structure is configured to constrain a lifting or lowering trajectory of the cleaning performing device 1.

In some embodiments, the cleaning driving module 12 may be a rotating assembly. The rotary assembly includes a rotary driving motor 211 (ie, a power source) and a rotary transmitting mechanism 212 (ie, a transmitting mechanism). The rotary transmitting mechanism 212 is connected to the rotary driving motor 211 and the cleaning module 11 to transmit motion to bring the cleaning module 11 to rotate. The driving device 2 is configured to drive the rotating assembly and the cleaning performing device 1 to move up and down. The driving device 2 is configured to drive the rotating assembly and the cleaning performing device 1 to move up and down.

The present disclosure can utilize the lift drive device 2 to drive the rotating assembly and the cleaning performing device 1 to move upward and keep the rotating assembly and the cleaning performing device 1 to remain at a raised position. In some periods when the cleaning apparatus is not required for cleaning, the rotating assembly and the cleaning performing device 1 remain at the raised position, to avoid the cleaning assembly affecting the movement of the cleaning apparatus, and improve the adaptability of the cleaning apparatus.

Figure 18:
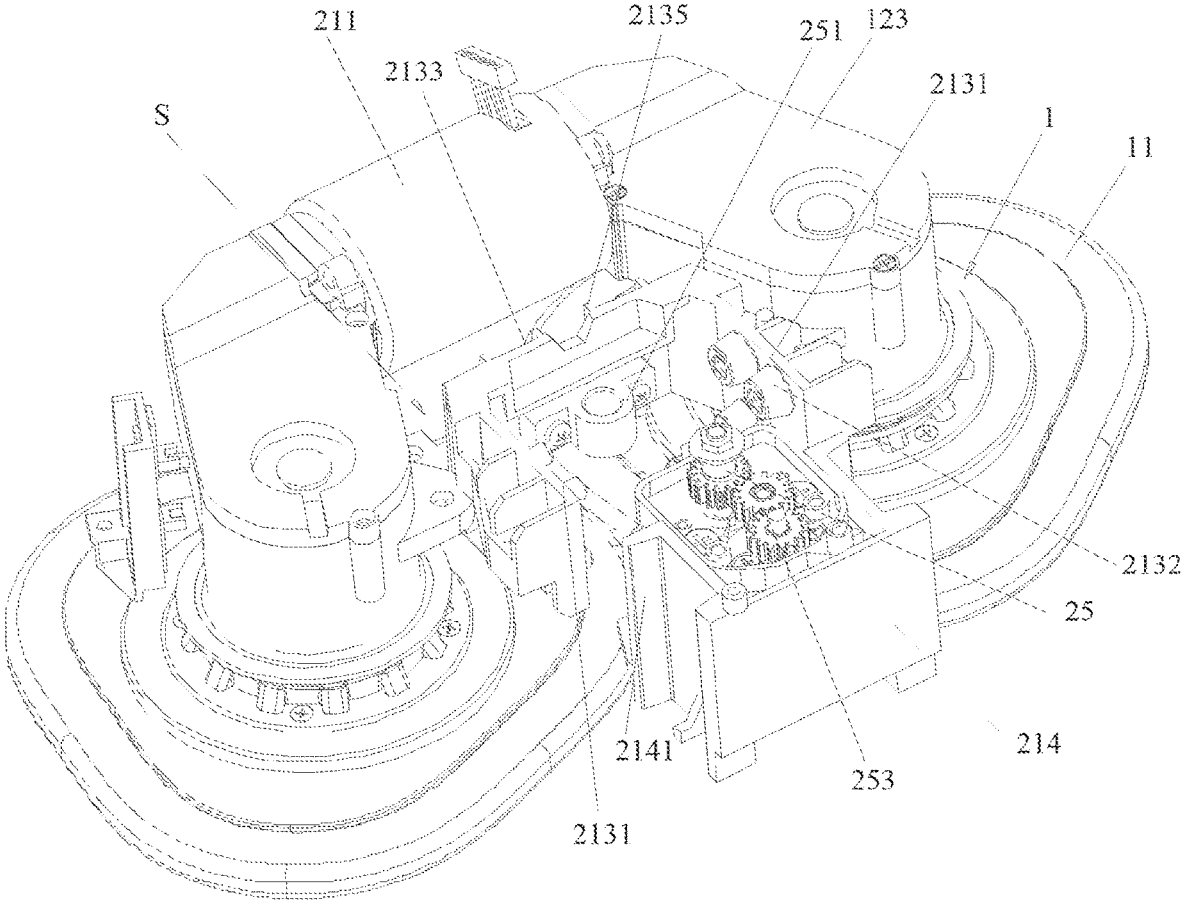
FIG. 18 is an exploded diagram of a cleaning assembly according to an embodiment of this disclosure.
Figure 22:
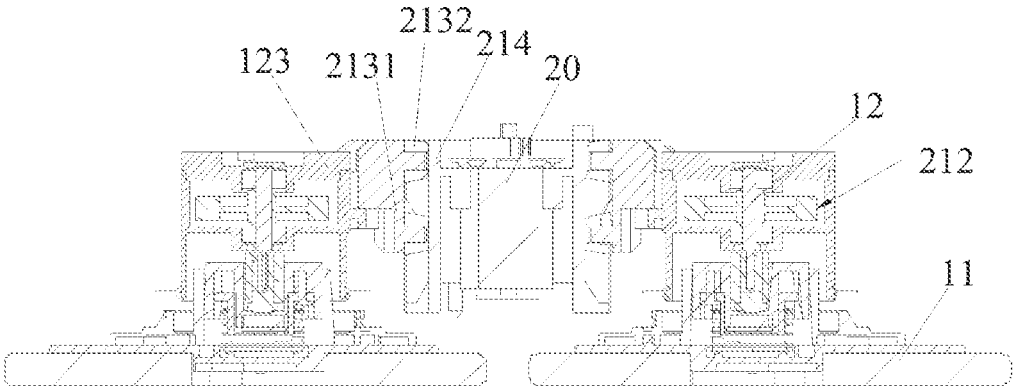
FIG. 22 is a cross-sectional view along the line A-A in FIG. 21.

Please referring to FIG. 18 and FIG. 22, In some instances, the cleaning performing device 1 further includes a rotating shaft 12 connected with the rotating transmitting mechanism 212 to transmit motion. The cleaning module 11 is mounted on the rotating shaft 12 and configured to rotate and rotatably clean the ground to be cleaned under a driving of the rotating shaft 12. Specifically, the cleaning module 11 is, but is not limited to, a mopping module.

Please referring to FIG. 18, FIG. 19, FIG. 22 and FIG. 23, In some instances, the driving device 2 may drive the constraining structure to move up and down, and the constraining structure is fixedly connected with the rotating assembly for linking with the constraining structure, for driving the rotating assembly to move up and down conveniently.

In some instances, the driving device 2 includes a power source 20 and a transmitting mechanism connected with the power source 20 to transmit motion, the power source 20 is fixedly connected with the cleaning performing device 1. The power source 20 includes a screw rod 25, a plurality of gears 253, and a sliding block 251 threadedly connected to the screw rod 25, the gears 253 are connected to the power source 20 and the screw rod 25 to transmit motion to drive the screw rod 25 to rotate. The sliding block 251 is connected to the constraining structure. The screw rod 25 is configured to rotate to drive the sliding block 251 and the constraining structure to move up and down. With this technical mean, the constraining structure can be driven to move up and down reliably. It should be noted that the sliding block 251 may be fixedly connected with the constraining structure, or may be integrally formed with the constraining structure, which are not limited in the present disclosure.

In addition, the transmitting mechanism may also be a transmitting belt, which is not limited here.

Figure 24:
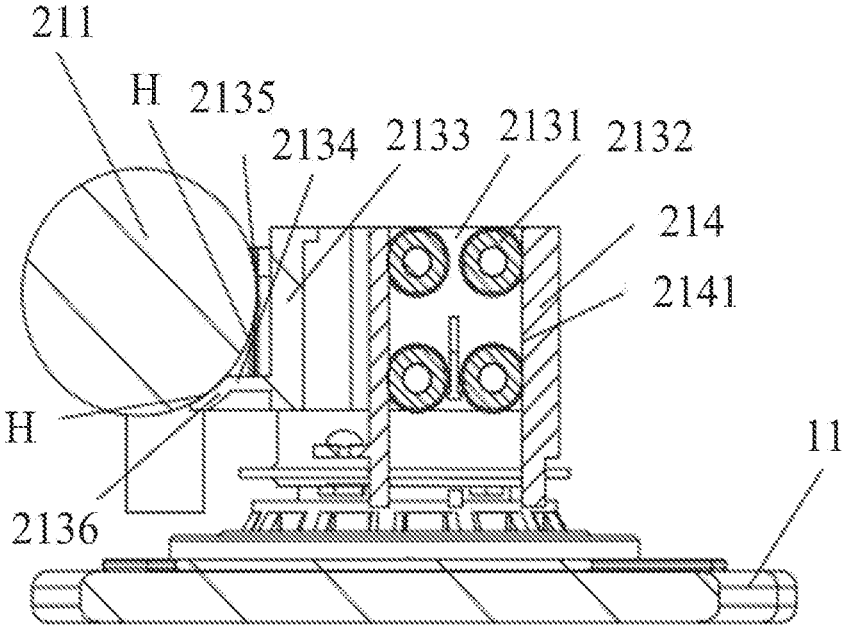
FIG. 24 is a cross-sectional view along the line C-C in FIG. 21.

Please referring to FIG. 18 and FIG. 24, specifically, the constraining structure includes two side plates 2131 arranged oppositely, and guide wheels 2132 respectively installed on inner sides of the two side plates 2131. The driving device 2 includes a mounting bracket 214, two opposite sides of the mounting bracket 214 include a guiding surface 2141, the guiding wheels 2132 are configured to rotate on the guiding surfaces 2141 to guide the constraining structure to move up and down reliably. With the technical means, the driving device 2 can move up and down reliably.

In a specific example, the power source 20 and the transmitting mechanism are mounted on the mounting bracket 214.

It can be understood that, in order to guide the constraining structure to move up and down reliably, the inner sides of the two side plates 2131 are provided with at least two guide wheels 2132 arranged in the vertical direction. In an exemplary embodiment, the inner sides of the two side plates 2131 are provided with two vertical rows of guide wheels 2132, each vertical row of guide wheels 2132 includes two guide wheels 2132, and two opposite sides of the bracket 214 have a guiding surface 2141, the two guiding surface 2141 are parallel to each other. The two vertical rows of guide wheels 2132 are located between the two guide surfaces 2141 and are in rolling fit with the two guide surfaces 2141 respectively.

Figure 19:
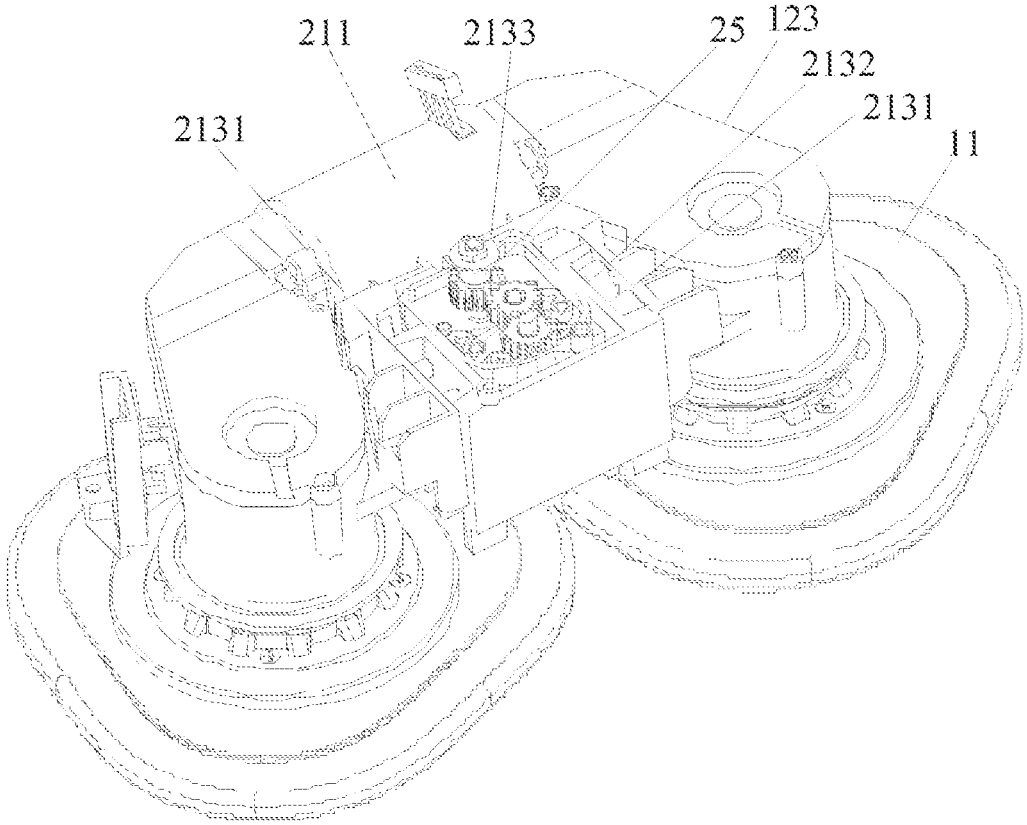
FIG. 19 is a structural diagram of the cleaning assembly according to an embodiment of this disclosure.
Figure 20:
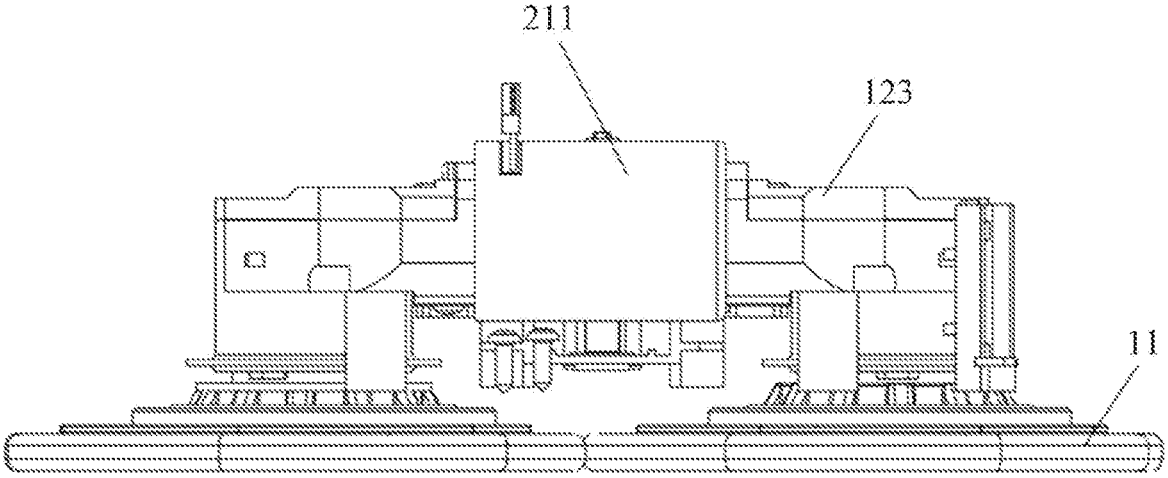
FIG. 20 is a side view of the cleaning assembly according to an embodiment of this disclosure.
Figure 21:
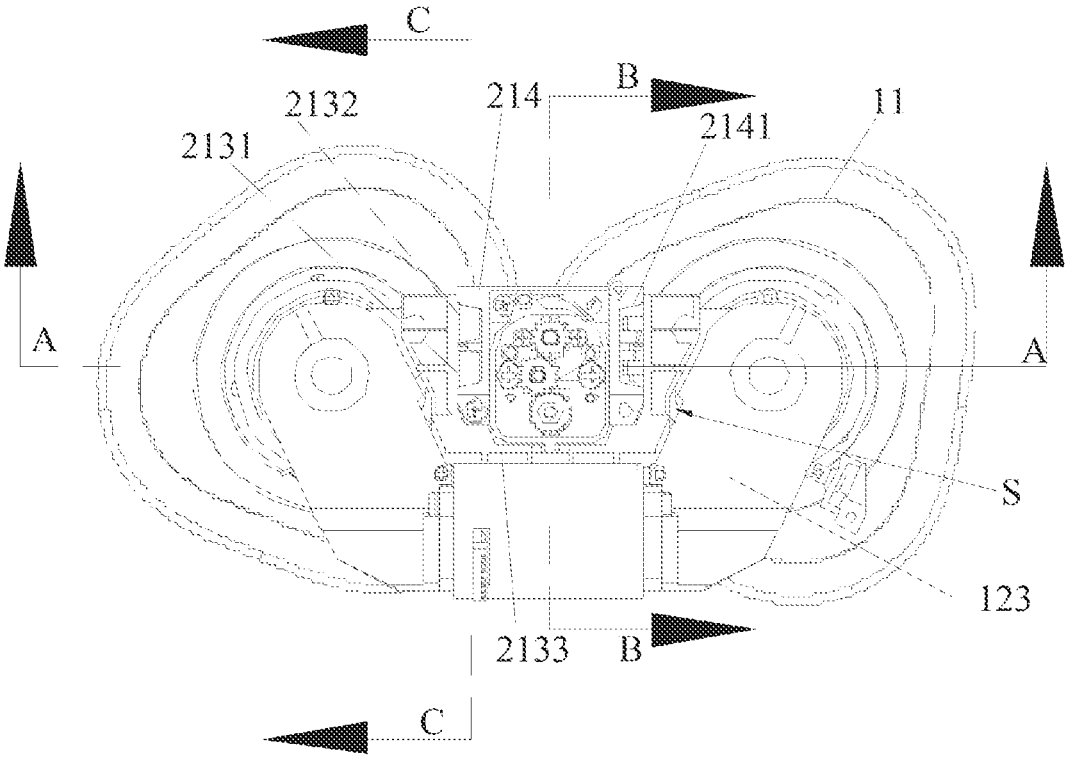
FIG. 21 is a top view of the cleaning assembly according to an embodiment of this disclosure.

Please referring to FIGS. 18, 19 and 22, In some instances, a quantity of the cleaning module 11 and the rotary transmitting mechanism 212 is two, the two cleaning module 11 are arranged side by side, and the two rotary transmitting mechanisms 212 are respectively connected to two opposite sides of the same rotary driving motor 211 to drive the corresponding cleaning module 11 to rotate. The two rotary transmitting mechanisms 212 are respectively installed in two transmitting boxes 123, and the two transmitting boxes 123 are offset to a same side relative to the rotary driving motor 211. The rotary driving motors 211 and the transmitting boxes 123 cooperatively form an accommodating space S, and the driving device 2 is arranged in the accommodating space S. Since the driving device 2 is disposed it the accommodating space S formed between the two transmission boxes 123 and the rotary driving motor 211, a space of the cleaning apparatus is used reasonably.

In some embodiments, the accommodating space S is substantially V-shaped, and includes a narrow end blocked by the rotary driving motor 211 and a wide open end.

Figure 23:
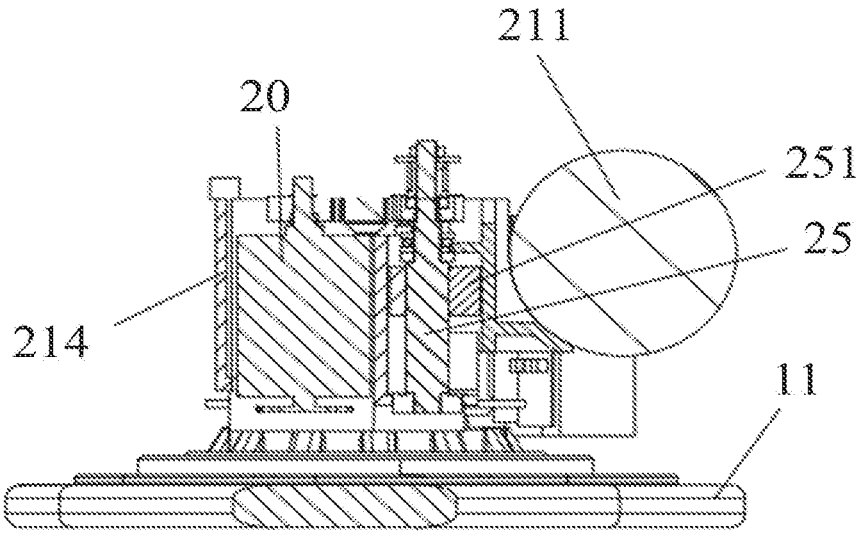
FIG. 23 is a cross-sectional view along the line B-B in FIG. 21.

Please referring to FIG. 18, FIG. 23 and FIG. 24, specifically, the constraining structure includes an end plate 2133 facing the rotary driving motor 211, and two side plates 2131 connected to both ends of the end plate 2133 and facing two sides of the two transmitting boxes 123 respectively. A side of the end plate 2133 facing away from the rotary drive motor 211 is connected with a sliding block 251, and inner side of the two sides plate 2131 are mounted with a guiding wheel 2132. The driving device 2 includes a bracket 214, a power source 20 and a transmission mechanism both mounted on the bracket 214. The lift transmitting mechanism includes a screw rod 25, a plurality of gears 253. and the sliding block 251, and the gears 253 are connected to the power source 20 and the screw rod 25 to transmit motion to drive the screw rod 25 to rotate. The screw rod 25 is threadedly connected to the sliding block 251, and the rotation of the screw rod 25 drives the sliding block 251 and the constraining structure to move up and down, and two opposite sides of the bracket 214 includes a guiding surface 2141 on which the guiding wheel 2132 rolls to guide the constraining structure to move up and down. Through this technical means, the constraining structure has a stable structure, and the constraining structure can be reliably driven by the driving device 2, for reliably bringing the rotating assembly and the cleaning performing device 1 to move.

In some embodiments, a bottom of the end plate 2133 facing a side of the rotary driving motor 211 is connected with an end plate 2134, and both ends of the end plate 2134 respectively extend into a bottom of the two transmitting boxes 123 and are fixedly connected with the transmitting boxes 123. With this technical means, a stable combination of the constraining structure and the rotating assembly can be achieved. Specifically, the constraining structure and the rotating assembly can be locked by a locking member such as a screw.

Further, a plurality of reinforcing ribs 2135 are formed between the end plate 2134 and the end plate 2133, and a side of the end plate 2134 away from the end plate 2133 and corresponding to the rotary driving motor 211 is extended out of the downward inclined extension plate 2136. The rotary driving motor is in the shape of a lying down cylinder. The plurality of reinforcing ribs 2135 and the extension plate 2136 respectively have an arc surface H that fits with the cylindrical surface of the rotary driving motor 211. By means of this technical means, the structural strength of the constraining structure can be further strengthened, and at the same time, the installation stability of the constraining structure and the compactness of the overall structure of the constraining structure can be facilitated.

While the present disclosure has been described in connection with what are presently considered to be the most practical and preferred embodiments, it is to be understood that the present disclosure is not to be limited to the disclosed embodiments, but on the contrary, is intended to cover various modifications and equivalent arrangement included within the spirit and scope of the present disclosure.

What is claimed is:

1. A cleaning assembly, configured to be fixed on a body of a cleaning apparatus through a fixing structure, comprising:

a cleaning performing device, comprising a cleaning module configured to clean a surface to be cleaned, and a cleaning driving module configured to drive the cleaning module to move relative to the surface to be cleaned;

a driving device, configured to drive the cleaning performing device to be lifted or lowered; and a constraining structure, configured to limit a lifting or lowering trajectory of the cleaning performing device;

wherein the constraining structure comprises a linkage structure connected between the cleaning performing device and the fixing structure, the linkage structure comprises a first connecting rod and a second connecting rod, and the first connecting rod is opposite to the second connecting rod in a direction of the cleaning performing device being lifted and lowered.

2. The cleaning assembly according to claim 1, wherein the linkage structure is linked to move to limit the lifting or lowering trajectory of the cleaning performing device.

3. The cleaning assembly according to claim 2, wherein the linkage structure is configured to move with a first fixed trajectory to limit lifting or lowering of the cleaning performing device with a second fixed trajectory; and/or constraints of the linkage structure to the cleaning performing device allows the cleaning performing device to swing during lifting or lowering.

4. The cleaning assembly according to claim 3, wherein the linkage structure is movably connected with the cleaning performing device and the fixing structure, the linkage structure, the cleaning performing device, and the fixing structure cooperatively form a multi-linkages structure.

5. The cleaning assembly according to claim 4, wherein, the first connecting rod has a first end hinged to the cleaning performing device and a second end hinged to the fixing structure; and the second connecting rod has a first end hinged to the cleaning performing device and a second end hinged to the fixing structure;

wherein the multi-linkages structure is a parallelogram linkage structure.

6. The cleaning assembly according to claim 1, wherein the driving device comprises:

a power source; and a transmitting mechanism connected between the power source and the cleaning performing device to transmit motion, the transmitting mechanism comprising a gear; and the cleaning performing device comprises:

a rack engaged with the gear, the rack being driven by the gear to be lifted when the gear rotates in a first direction, and the rack being driven by the gear to be lowered when the gear rotates in a second direction opposite to the first direction.

7. The cleaning assembly according to claim 6, wherein the linkage structure has a fixed trajectory matched to a trajectory of the rack; and the linkage structure is linked to move to constrain the lifting or lowering trajectory of the cleaning performing device.

8. The cleaning assembly according to claim 1, wherein the driving device comprises:

a power source; and a transmitting mechanism connected between the power source and the cleaning performing device to transmit motion, the transmitting mechanism comprising a moving member capable of moving up and down, the cleaning performing device being configured to be lifted by the moving member along with lifting of the moving member, and the cleaning performing device being configured to fall back along with lowering of the moving member.

9. The cleaning assembly according to claim 1, wherein the driving device comprises:

a power source; and a transmitting mechanism connected between the power source and the cleaning performing device to transmit motion, the transmitting mechanism comprising:

a driving wheel driven by the power source, at least one driven wheel, and a transmitting belt arranged around the driving wheel and the at least one driven wheel and connected to the cleaning performing device, the transmitting belt being configured to drive the cleaning performing device to be lifted when the driving wheel rotates in a first direction, and the transmitting belt being configured to drive the cleaning performing device to be lowered when the driving wheel rotates in a second direction opposite to the first direction.

10. The cleaning assembly according to claim 9, wherein the transmitting mechanism comprises:

at least two driven wheels; and a movable tensioning structure, one of the at least two driven wheels being mounted on the tensioning structure, the transmitting belt being configured to remain in a tensioned state under an action of the tensioning structure and the driven wheel, and positions of the transmitting belt, the driven wheel mounted on the tensioning structure, and the tensioning structure being adaptively changed according to a change of a movement trajectory of the cleaning performing device under constraints of the constraining structure.

11. The cleaning assembly according to claim 1, wherein the driving device comprises:

a power source; and a transmitting mechanism connected between the power source and the cleaning performing device to transmit motion, the transmitting mechanism comprising a winding mechanism, the winding mechanism comprising:

a winding wheel driven by the power source, and a winding belt connected to the winding wheel, one end of the winding belt away from the winding wheel being connected to the cleaning driving module, the winding belt being wound on the winding wheel to drive the cleaning driving module to be lifted under constraints of the constraining structure when the winding wheel rotates in a first direction, the winding belt being gradually loosen from the winding wheel when the winding wheel rotates in a second direction opposite to the first direction, and the cleaning performing device being configured to fall back under the constraints of the constraining structure.

12. The cleaning assembly according to claim 1, wherein the driving device comprises:

a power source; and a transmitting mechanism connected between the power source and the cleaning performing device to transmit motion, the transmitting mechanism comprising a moving member driven by the power source to perform a reciprocating linear movement, the moving member comprising a first sliding part;

the cleaning performing device comprising:

a second sliding part, slidably matched with the first sliding part, the first sliding part being configured to be lifted relative to the second sliding part along a direction angled with a first direction under constraints of the constraining structure when the moving member moves in the first direction.

13. The cleaning assembly according to claim 1, wherein the driving device comprises:

a power source fixed to the cleaning performing device; and a transmitting mechanism connected to the power source to transmit motion, the transmitting mechanism comprising a gear engaged with a rack connected to the fixing structure, the driving device and the cleaning performing device being driven to be lifted when the gear rotates in a first direction and moves upward along the rack, and the driving device and the cleaning performing device being driven to be lowered when the gear rotates in a second direction opposite to the first direction and moves downward.

14. The cleaning assembly according to claim 1, wherein the driving device comprises:

a power source fixed to the cleaning performing device; and a transmitting mechanism connected to the power source to transmit motion, the transmitting mechanism comprising:

a screw rod, a gear, connected with the power source and the screw rod to drive the screw rod to rotate, and a sliding block threaded to the screw rod and connected to the constraining structure, the screw rod being configured to rotate to drive the sliding block and the constraining structure to be lifted or lowered.

15. The cleaning assembly according to claim 1, wherein the constraining structure comprises:

two opposite side plates, an inner wall of each of the two side plates being provided with at least one guiding wheel;

wherein the driving device comprises:

a mounting bracket having a guiding surface on each of two opposite sides thereof, the guiding wheels being configured to rotate on the guiding surfaces to guide the constraining structure to be lifted or lowered.

16. The cleaning assembly according to claim 1, wherein a connecting position of the cleaning performing device and the first connecting rod is opposite to a connecting position of the cleaning performing device and the second connecting rod in the direction of the cleaning performing device being lifted and lowered; and a connecting position of the fixing structure and the first connecting rod is opposite to a connecting position of the fixing structure and the second connecting rod in the direction of the cleaning performing device being lifted and lowered.

17. A cleaning apparatus, comprising a body, a fixing structure, and a cleaning assembly configured to be fixed on the body through the fixing structure, wherein the cleaning assembly comprises:

a cleaning performing device, comprising a cleaning module configured to clean a surface to be cleaned, and a cleaning driving module configured to drive the cleaning module to move relative to the surface to be cleaned;

a driving device, configured to drive the cleaning performing device to be lifted or lowered; and a constraining structure, configured to constrain a lifting or lowering trajectory of the cleaning performing device;

wherein the constraining structure comprises a linkage structure connected between the cleaning performing device and the fixing structure, the linkage structure comprises a first connecting rod and a second connecting rod, and the first connecting rod is opposite to the second connecting rod in a direction of the cleaning performing device being lifted and lowered.

* * * * *